US008152548B2

(12) United States Patent
Masuda et al.

(10) Patent No.: US 8,152,548 B2
(45) Date of Patent: Apr. 10, 2012

(54) CONNECTOR APPARATUS

(75) Inventors: Yasushi Masuda, Shinagawa (JP); Manabu Shimizu, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/781,013

(22) Filed: May 17, 2010

(65) Prior Publication Data

US 2010/0297893 A1 Nov. 25, 2010

(30) Foreign Application Priority Data

May 20, 2009 (JP) ..... 2009-122501

(51) Int. Cl.
*H01R 13/28* (2006.01)

(52) U.S. Cl. ..... 439/291; 439/678

(58) Field of Classification Search ..... 439/290, 439/291, 619, 678, 699.1
See application file for complete search history.

(56) References Cited

U.S. PATENT DOCUMENTS

| | | | | |
|---|---|---|---|---|
| 5,098,311 | A * | 3/1992 | Roath et al. | 439/295 |
| 6,193,537 | B1 * | 2/2001 | Harper et al. | 439/291 |
| 6,379,170 | B1 * | 4/2002 | Czeschka et al. | 439/291 |
| 7,335,069 | B1 * | 2/2008 | Williams et al. | 439/709 |
| 7,374,460 | B1 * | 5/2008 | Hariharesan et al. | 439/679 |
| 7,377,803 | B2 | 5/2008 | Matsuoka | |
| 7,425,145 | B2 * | 9/2008 | Ngo | 439/290 |
| 7,749,029 | B1 * | 7/2010 | Pontillo, II | 439/678 |
| 7,824,187 | B1 * | 11/2010 | Yi | 439/65 |
| 2005/0014409 | A1 * | 1/2005 | Yang et al. | 439/290 |
| 2007/0275586 | A1 * | 11/2007 | Ngo | 439/290 |
| 2008/0064229 | A1 * | 3/2008 | Tokunaga | 439/59 |
| 2009/0047816 | A1 * | 2/2009 | Lappoehn | 439/291 |
| 2010/0297893 | A1 * | 11/2010 | Masuda et al. | 439/733.1 |

FOREIGN PATENT DOCUMENTS

JP 2005-129255 5/2005

* cited by examiner

*Primary Examiner* — James Harvey
(74) *Attorney, Agent, or Firm* — IPUSA, PLLC

(57) ABSTRACT

A connector apparatus includes first and second connectors that can be engaged with each other. The first connector includes a first contact and a first main body that supports the first contact. The first connector is conductive. The first main body is insulative. The second connector includes a second contact and a second main body that supports the second contact. The second contact is conductive. The second main body is insulative. The first contact includes a first connection part that can contact the second contact. The second contact includes a second connection part that can contact the first connection part at plural portions of the first connection part. The first and second connection parts substantially have the same shape and size.

3 Claims, 19 Drawing Sheets

CONNECTOR APPARATUS

BACKGROUND OF THE INVENTION

1. Field of the Invention

The present invention generally relates to a connector apparatus including first and second connectors engageable with each other.

2. Description of the Related Art

As one example of a conventional connector apparatus including first and second connectors engageable with each other, Japanese Laid-Open Patent Publication No. 2005-129255 (see, paragraphs 33, 37, and 65, FIG. 15) discloses a connector apparatus having a first contact (terminal) assembled in the first connector and a second contact (terminal) assembled in the second connector in which the first contact has a male contact part (hereinafter also referred to as "inserting contact part") and the second contact has a female contact part (hereinafter also referred to as "receiving contact part"). This connector apparatus provides a reliable connection because the first and second contacts are in conduction at two contact points when the first and second connectors are engaged.

However, the connector apparatus disclosed in Japanese Laid-Open Patent Publication No. 2005-129255 incurs high manufacturing costs because the inserting contact part and the receiving contact part have different shapes.

SUMMARY OF THE INVENTION

The present invention may provide a connector apparatus that substantially eliminates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a connector apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment the invention provides a connector apparatus including: first and second connectors that can be engaged with each other; wherein the first connector includes a first contact and a first main body that supports the first contact, the first connector being conductive, the first main body being insulative, wherein the second connector includes a second contact and a second main body that supports the second contact, the second contact being conductive, the second main body being insulative, wherein the first contact includes a first connection part that can contact the second contact, wherein the second contact includes a second connection part that can contact the first connection part at plural portions of the first connection part, wherein the first and second connection parts substantially have the same shape and size. Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 1:
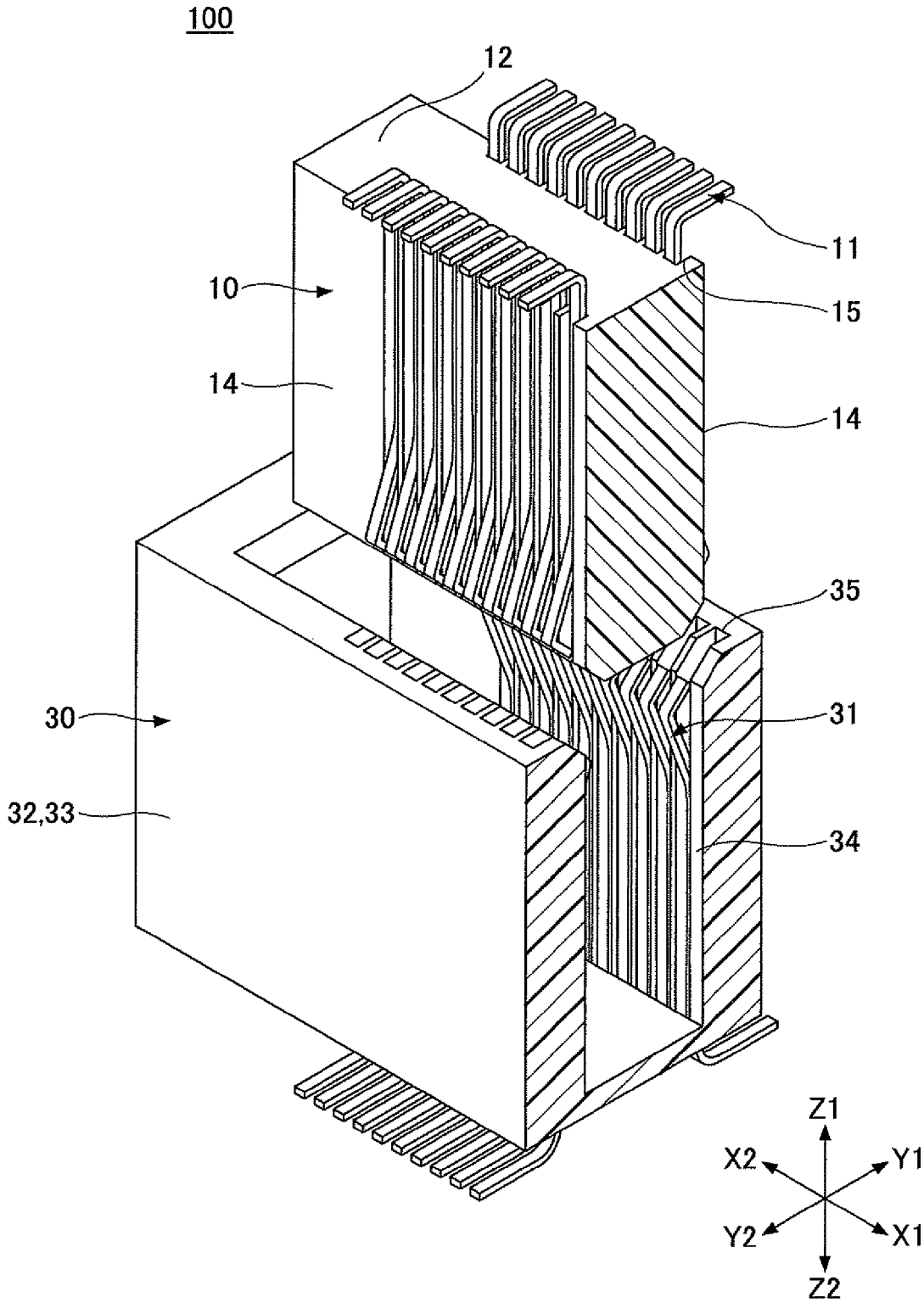
FIG. 1 is a perspective view of a connector apparatus according to a first embodiment of the present invention in a state before engaging first and second connectors.
Figure 2A:
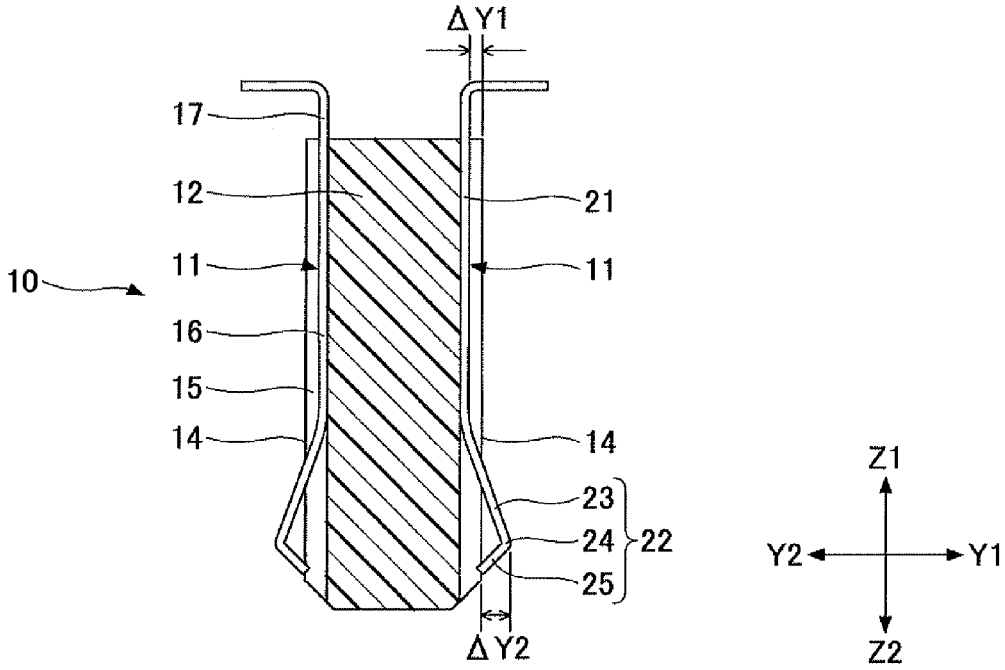
FIGS. 2A and 2B are cross-sectional views illustrating main parts of the connector apparatus illustrated in FIG. 1.
Figure 2B:
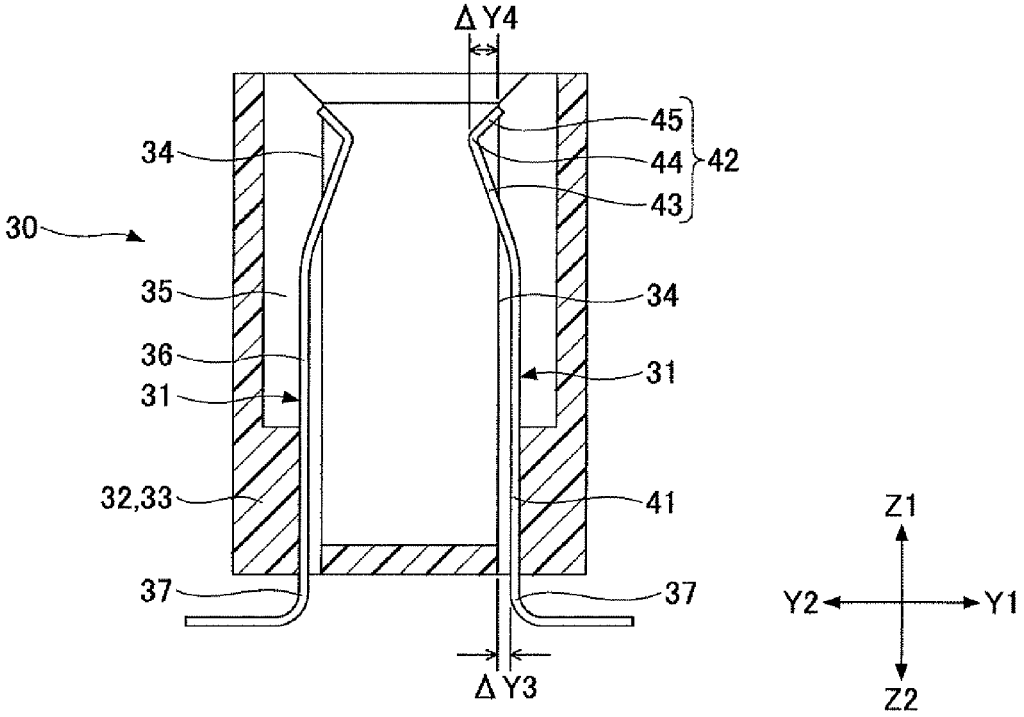

FIG. 1 is a perspective view of a connector apparatus 100 according to a first embodiment of the present invention in a state before engaging the below-described first and second connectors 10, 30. FIGS. 2A and 2B are cross-sectional views illustrating main parts of the connector apparatus 100 illustrated in FIG. 1. In FIGS. 1 through 19, directions X1-X2, Y1-Y2, Z1-Z2 indicate the longitudinal direction, the width direction, and the height direction of the first connector 10 (second connector 30), respectively.

The connector apparatus 100 is used for electrically connecting electronic devices such as computers, servers, switchboards, etc. The connector apparatus 100 includes the first connector 10 and the second connector 30.

The first connector 10, which is a plug type connector, is mounted on a first circuit board (not illustrated). The second connector 30, which is a jack type connector, is mounted on a second circuit board (not illustrated). The first and second circuit boards become electrically connected by mutually engaging the first and second connectors 10, 30.

First, an exemplary configuration of the first connector 10 is described with reference to FIGS. 1, 2A, and 2B.

The first connector 10 includes plural first contacts 11 and a first main body 12 that supports the first contacts 11. The first contacts 11 are conductive. The first main body 12 is insulative.

The first main body 12 has a rectangular column-like shape. The first main body 12 includes four outer walls 14 which serve as engagement planes. Among the four outer walls 14, the pair of outer walls 14 positioned opposite to each other in the Y1-Y2 direction have plural first groove parts 15 formed at a predetermined interval in the X1-X2 direction.

The first groove parts 15 extend in the Z1-Z2 direction. As illustrated in FIGS. 2A and 2B, the depth of the first groove part 15 (length of the first groove part 15 in the Y1-Y2 direction) is substantially uniform. The first contacts 11 are inserted into the corresponding first groove parts 15 one by one from the Z1 direction to the Z2 direction.

The first contacts 11 are symmetrically arranged in pairs in the Y1-Y2 directions. The pairs of first contacts 11 are for transmitting signals of positive/negative symmetric waveforms (i.e. balanced signals). The pairs of contacts 11 are arranged at a predetermined interval in the X1-X2 direction.

The first contact 11 has a first connection part 16 provided on one end in the longitudinal direction and a first lead part 17 provided on the other end in the longitudinal direction. The first connection part 16 is for connecting with a below-described second contact 31. The first lead part 17 is to be soldered to a conductor on the first circuit board (not illustrated).

The first connection part 16 has a first target support part 21 and a first arm part 22 formed as an integrated body. The first target support part 21 is to be supported by the first main body 12. The first arm part 22 is bendable having the first target support part 21 serve as a fulcrum of the bending. The first arm part 22 is positioned at an end opposite to that of the first lead part 17 where the first target support part 21 is positioned substantially at the midpoint of the first contact 11.

The first target support part 21 is directly supported by the first main body 12 by contacting a bottom plane (surface) of the first groove part 15 (bottom plane of Y1 side or bottom plane of Y2 side). The first target support part 21 is formed having a thickness (Y1-Y2 thickness) that is less than the depth of the first groove part 15. The first target support part 21 is inserted inward (Y1 direction or Y2 direction) at a distance (amount) of ΔY1 from the engagement plane (outer wall) 14.

Engagement claws (not illustrated) are integrally formed on the side planes (plane of X1 side or plane of X2 side) of the first target support part 21. The engagement claws of the first target support part 21 are inserted into the first groove part 15 and pressed against the side planes (plane of X1 side or plane of X2 side) of the first groove part 15, so that the first contact 11 can be prevented from disengaging from the first main body 12.

The first arm part 22 has a first stem part 23, a first bent part 24, and a first tip part 25 that are formed as an integrated body. The first stem part 23 extends from a Z2 end of the first target support part 21 and gradually separates from the bottom plane of the first groove part 15 as the first stem part 23 further extends in the Z2 direction.

The first bent part 24 extends in a Z2 end of the first stem part 23. The peak of the first bent part 24 projects a predetermined amount ΔY2 (distance) outward (side of Y2 or side of Y1).

The first tip part 25 extends from a Z2 end of the first bent part 24 and gradually becomes closer to the first main body 12 toward the bottom plane of the first groove part 15. Therefore, the first arm part 22 elastically deforms with respect to the bending fulcrum in a manner becoming closer to the bottom plane of the first groove part 15. That is, the first arm part 22 elastically deforms in a manner to be buried into the corresponding first groove part 15 of the first main body 12 when the first tip part 25 is pressed in the Z1 direction.

The tip (tip toward the Z2 direction) of the first tip part 25 is positioned slightly more inward (side of Y1 or side of Y2) with respect to the engagement plane 14 when the first tip part 25 has no external force applied. That is, the first tip part 25 has its tip positioned inside the first groove part 15. Thereby, the first arm part 22 can be guided toward the first main body 12 in the burial direction (Y1-Y2) with respect to the first groove part 15.

Next, an exemplary configuration of the second connector 30 is described with reference to FIGS. 1, 2A, and 2B.

The second connector 30 includes plural second contacts 31 and a second main body 32 that supports the second contacts 31. The second contacts 31 are conductive. The second main body 32 is insulative.

The second main body 32 has an engagement part 33 that is detachably engaged with the first main body 12. The engagement part 33 has a rectangular cylinder-like shape. The second main body 32 has a rectangular column-like shape including four inner walls (engagement planes) 34 that can be detachably engaged with the first main body 12. Among the four inner walls 34, the pair of inner walls 34 positioned opposite to each other in the Y1-Y2 direction have plural second groove parts 35 formed at a predetermined interval in the X1-X2 direction.

The second groove parts 35 extend in the Z1-Z2 direction. The second groove part 35 is configured having two levels of depths (length in Y1-Y2 direction). The second groove part 35 has a Z2 groove (groove positioned towards the Z2 direction) that is formed shallower than a Z1 groove (groove positioned towards the Z1 direction). The second contacts 31 are inserted into corresponding second groove parts 35 one by one from the Z2 direction to the Z1 direction.

The second contacts 31 are symmetrically configured with the respective first contacts 11. The second contacts 31 have substantially the same shape and size as the first contacts 11. The second contacts 31 are symmetrically arranged in pairs in the Y1-Y2 directions. The pairs of second contacts 31 are also for transmitting signals of positive/negative symmetric waveforms (i.e. balanced signals). The pairs of contacts 11 are arranged at a predetermined interval in the X1-X2 direction.

The second contact 31 has a second connection part 36 provided on one end in the longitudinal direction and a second lead part 37 provided on the other end in the longitudinal direction. The second connection part 36 is for connecting with a corresponding first contact 11. The second lead part 37 is to be soldered to a conductor on the second circuit board (not illustrated).

The second connection part 36 has a second target support part 41 and a second arm part 42 formed as an integrated body. The second target support part 41 is to be supported by the second main body 32. The second arm part 42 is bendable having the second target support part 41 serving as a fulcrum of the bending. The second arm part 42 is positioned at an end opposite to that of the second lead part 37 where the second target support part 41 is positioned substantially at the midpoint of the second contact 31.

The second target support part 41 is directly supported by the second main body 32 by contacting a bottom plane of the Z2 groove of the second groove part 35 (bottom plane of the Z2 groove towards the Y1 side or bottom plane of the Z2 groove towards Y2 side). The second target support part 41 is formed having a thickness (planar thickness) that is less than the depth of the Z2 groove of the second groove part 35. The second target support part 41 is inserted inward (Y1 direction or Y2 direction) at a distance (amount) of $\Delta Y3$ ($\Delta Y3<\Delta Y2$) from the engagement plane (inner wall) 34.

Engagement claws (not illustrated) are integrally formed at the side planes (plane of X1 side or plane of X2 side) of the second target support part 41. The engagement claws of the second target support part 41 are inserted into the second groove part 35 and pressed against the side planes (plane of X1 side or plane of X2 side) of the second groove part 35, so that the second contact 31 can be prevented from disengaging from the second main body 32.

The second arm part 42 has a second stem part 43, a second bent part 44, and a second tip part 45 that are formed as an integrated body. The second stem part 43 extends from a Z2 end of the second target support part 41 and gradually separates from the bottom plane of Z2 groove of the second groove part 35 as the second stem part 43 further extends in the Z1 direction.

The second bent part 44 extends from a Z1 end of the second stem part 43. The peak of the second bent part 44 projects a predetermined amount $\Delta Y4$ (distance) outward (side of Y2 or side of Y1).

The second tip part 45 extends from a Z1 end of the second bent part 44 and gradually becomes closer to the second main body 32 toward the bottom plane of the second groove part 35. Therefore, the second arm part 42 elastically deforms with respect to the bending fulcrum in a manner becoming closer toward the bottom plane of the second groove part 35. That is, the second arm part 42 elastically deforms in a manner to project into the corresponding second groove part 35 of the second main body 42 when the second tip part 45 is pressed in the Z2 direction.

The tip (tip towards the Z1 direction) of the second tip part 45 is positioned slightly more inward (side of Y1 or side of Y2) with respect to the engagement plane 34 when the second tip part 45 has no external force applied. That is, the second tip part 45 has its tip positioned inside the second groove part 35. Thereby, the second arm part 42 can be guided toward the second main body 32 in the projecting direction (Y1-Y2 direction) with respect to the second groove part 35.

The first and second contacts 11, 31 are formed by performing a punching process or a bending process on a conductive metal board. In this embodiment, because the first and second contacts 11, 31 are formed with substantially the same shape and size, plural different types of molds are not necessary. Thus, manufacturing costs can be reduced. Further, because the first and second contacts 11, 31 are formed with substantially the same shape and size, plural different types are not required to be managed (handled). Thus, managing (handling) costs can also be reduced.

It is to be noted that the first and second connection parts 16, 36 have substantially the same shape and size and the first and second lead parts 17, 37 have substantially have the same shape and size because the first and second contacts 11, 31 have substantially the same shape and size. However, the shape of the first target support part 21 is slightly different from the shape of the second support part 41, and the shape of the first arm part 22 is slightly different from the shape of the second arm part 42 because the second groove part 35 is formed having two levels of depth.

Figure 3:
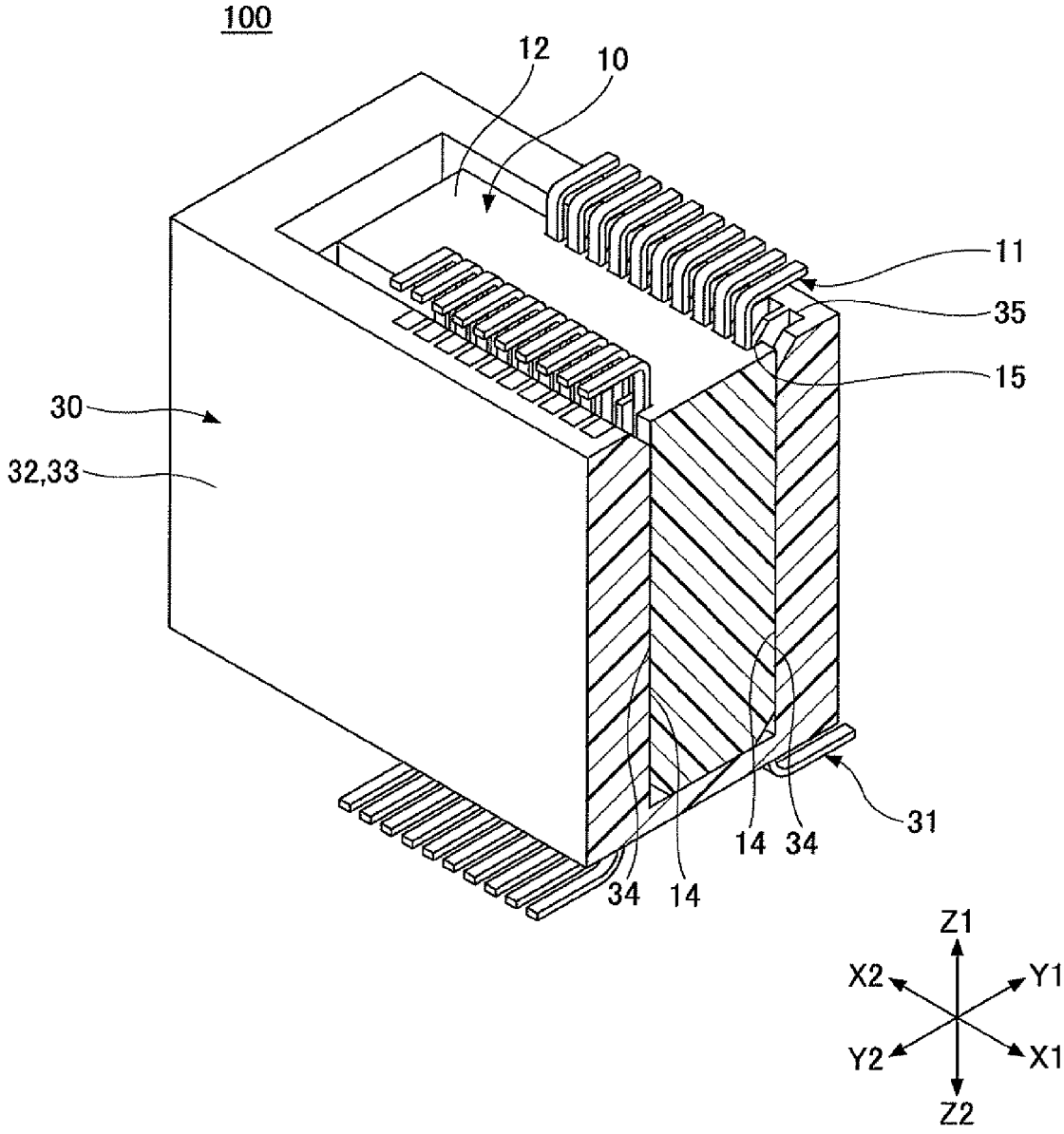
FIG. 3 is a fragmentary perspective view illustrating a state of a connector apparatus after engaging first and second connectors according to an embodiment of the present invention.
Figure 4:
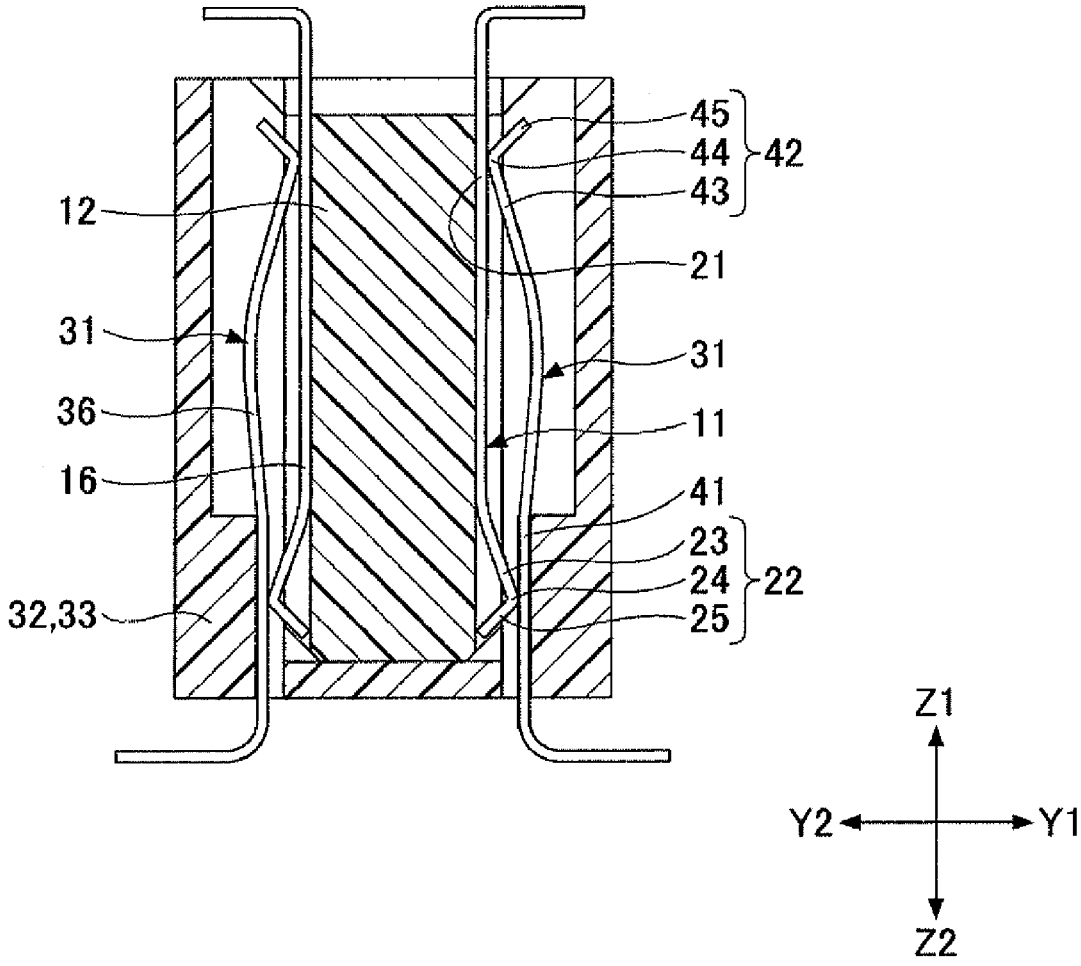
FIG. 4 is a cross-sectional view illustrating a main part of the connector apparatus 100 of FIG. 3.

Next, the movement (operation) of the first and second arm parts 22, 42 in a case of engaging the first and second connectors 10, 30 are described with reference to FIGS. 3 and 4. FIG. 3 is a fragmentary perspective view illustrating a state of the connector apparatus 100 after engaging the first and second connectors 10, 30. FIG. 4 is a cross-sectional view illustrating a main part of the connector apparatus 100 of FIG. 3.

At the beginning of engaging the first and second connectors 10, 30, the four engagement planes 14 of the first main body 12 are slid into contact with corresponding engagement planes 34 of the second main body 32. At this beginning stage of engagement, the positions of the first groove parts 15 are matched with the positions of the respective plural second groove parts 35. As a result, the positions of the first contacts 11 are matched with the positions of the corresponding second contacts 31. In this matched state, the first tip parts 25 of the first arm parts 22 are drawn closer to corresponding second tip parts 45 of the second arm parts 42.

As the first and second tip parts 25, 45 make contact and advance in opposite directions (Z1 direction, Z2 direction) due to the engagement, the first and second arm parts 22, 42 bend (undergo elastic deformation) having the first and second target support parts 21, 41 serve as the fulcrums of the bending. Accordingly, the first arm parts 22 project into the first main body 12 and the second arm parts 42 are buried into the second main body 32. When the peak of the first arm part 22 contacts an apex of the second arm part 42, the first arm part 22 projects furthest into the first main body 12 and the second arm part 42 projects furthest into the second main body 32.

As the peak of the first bent part 24 of the first arm part 22 advances further and passes the peak of the second bent part 44 of the second arm part 42, the peak of the first bent part 24 contacts the second base part 43 and then contacts the second target support part 41. The second target support part 41 is inserted inward past the engagement plane 34 (side of Y1 or side of Y2) in an amount (distance) of $\Delta Y3$ when no external force is applied. The peak of the first bent part 24 of the first arm part 22 protrudes outward with respect to the engagement plane 14 in an amount (distance) of $\Delta Y2$ ($\Delta Y2>\Delta Y3>0$) when in a state where no external force is applied thereto. Accordingly, when the peak of the first bent part 24 of the first arm part 22 contacts the second target support part 41, the resilient recovering force of the first arm part 22 enables the first arm part 22 to be in forced contact with the second target support part 41. Thereby, the first and second contacts 11, 31 can be positively connected.

On the other hand, as the peak of the second bent part 44 of the second arm part 42 advances further and passes the peak of the first bent part 24, the peak of the second bent part 44 contacts the first stem part 23 and then contacts the first target support part 21. The first target support part 21 is inserted inward with respect to the engagement plane 14 (side of Y1 or side of Y2) in an amount (distance) of $\Delta Y1$ when no external force is applied. The peak of the second bent part 44 of the second arm part 42 protrudes outward with respect to the engagement plane 34 in an amount (distance) of $\Delta Y4$ ($\Delta Y4>\Delta Y1>0$) when no external force is applied. Accordingly, when the peak of the second bent part 44 of the second arm part 42 contacts the first target support part 21, the resilient recovering force of the second arm part 42 enables the second arm part 42 to be in forced contact with the first target support part 21. Thereby, the first and second contacts 11, 31 can be positively connected.

Accordingly, because the first arm part 22 resiliently contacts the second target support part 41 and the second arm part 42 resiliently contacts the first target support part 21, the first and second connection parts 16, 36 are in contact at two points (two areas). Thereby, the reliability of the connection between the first and second connectors 10, 30 can be improved.

With the above-described embodiment of the present invention, the reliability of connection between the first and second connectors 10, 30 can be improved because the first and second connection parts 16, 36 are connected at two points (two areas) when the first and second connectors 10, 30 are engaged. Further, different types of molding dies are not required because the first and second contacts 11, 31 are formed having substantially the same shape and size. Therefore, manufacturing costs can be reduced. Further, plural types of contacts are not required to be managed (handled) because the first and second contacts 11, 31 are formed having substantially the same shape and size. Therefore, management (handling) costs can be reduced.

With the above-described embodiment of the present invention, the first arm parts 22 resiliently deform and contact the second target support parts 41 and the second arm parts 42 resiliently deform and contact the first target support parts 21 by engaging the first and second connectors 10, 30. Accordingly, the resilient recovering force of the first and second arm parts 22, 42 improves the bond between the first and second connection parts 16, 36. Thus, the connection between the first and second connection parts 16, 36 can be more reliable.

It is to be noted that, although the first connector 10 (second connector 30) is mounted on a circuit board in the above-described embodiment of the present invention, the first connector 10 (second connector 30) may be mounted on other devices and apparatuses. For example, the first connector 10 (second connector 30) may be a cable connector for connecting with a cable. In this example, the first lead part 17 (second lead part 37) is connected to a wired conductor exposed on one end of a cable.

Although the first lead part 17 (second lead part 37) is soldered to a conductor on a circuit board in the above-described embodiment of the present invention, the first lead part 17 (second lead part 37) may be connected to other devices and apparatuses or connected by using other methods. For example, the first lead part 17 (second lead part 37) may be inserted in a through-hole of a circuit board.

Although the pair of first contacts 11 (pair of second contacts 31) opposite to each other in the Y1-Y2 direction of the above-described embodiment of the present invention are for transmitting balanced signals, the pair of first contacts 11 (pair of second contacts 31) may transmit other signals.

Further, ground planes may be arranged between adjacent contacts 11, 31 for preventing cross-talk.

Second Embodiment

Figure 5:
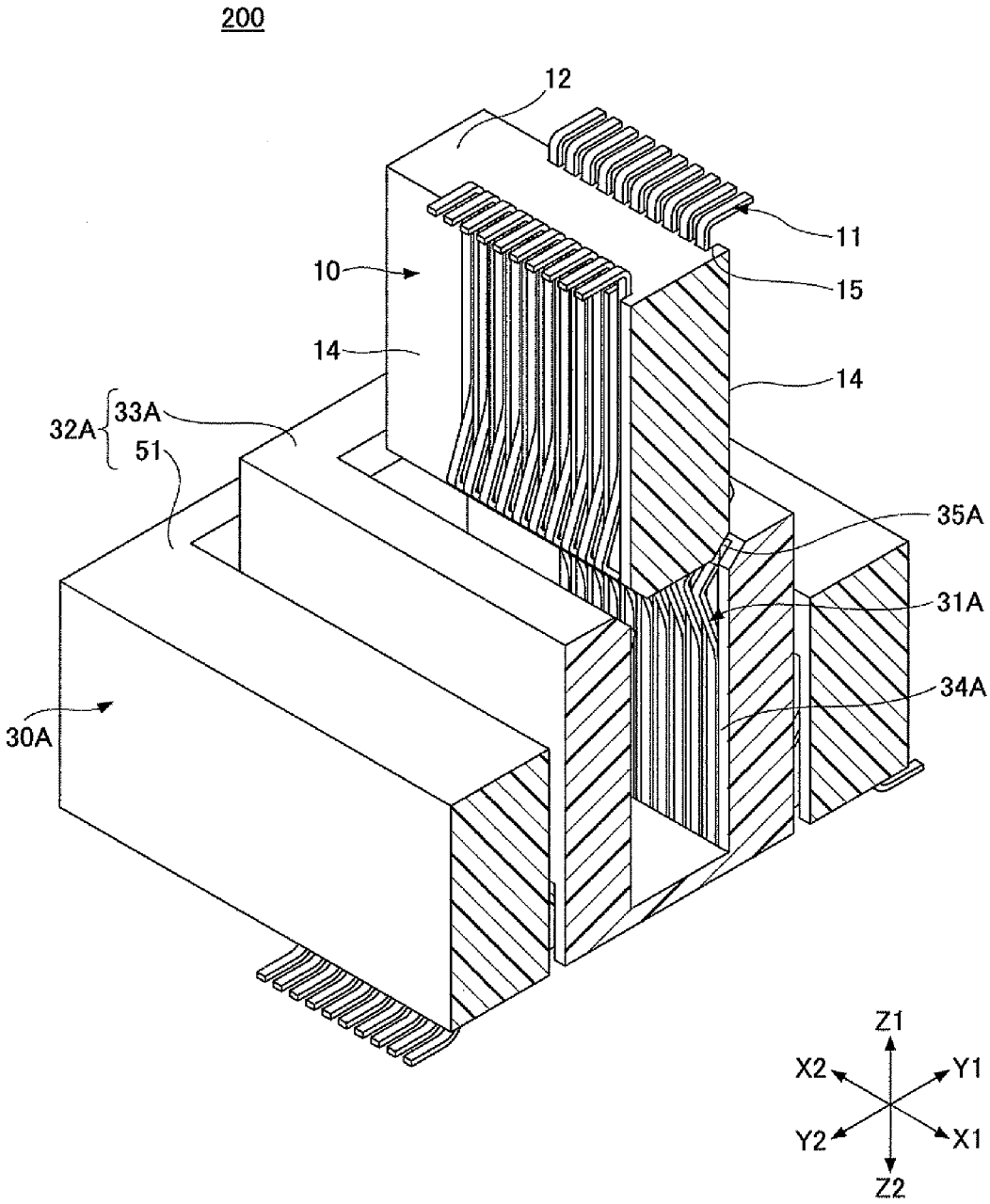
FIG. 5 is a perspective view of a connector apparatus according to a second embodiment of the present invention in a state before engaging a first connector with a second connector.
Figure 6:
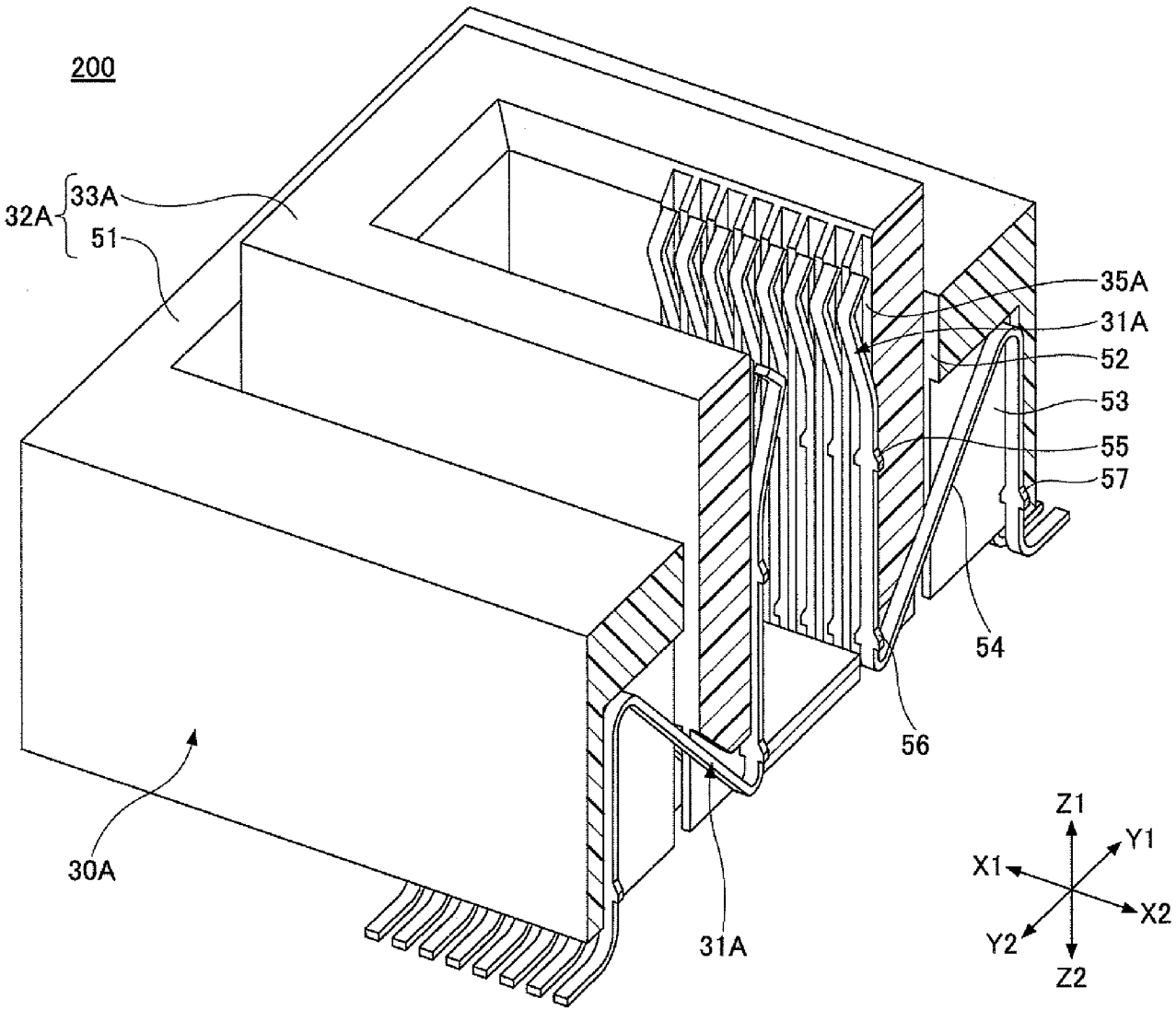
FIG. 6 is a fragmentary perspective view illustrating a state of a connector apparatus before engaging first and second connectors according to the second embodiment of the present invention.
Figure 7A:
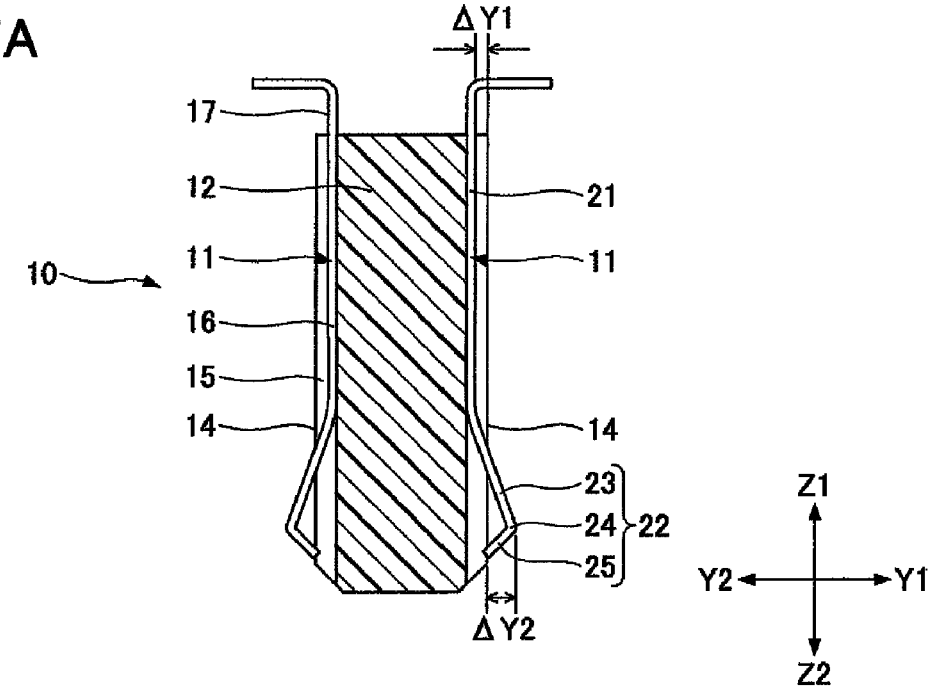
FIGS. 7A and 7B are cross-sectional views illustrating main parts of the connector apparatus of FIG. 5.
Figure 7B:
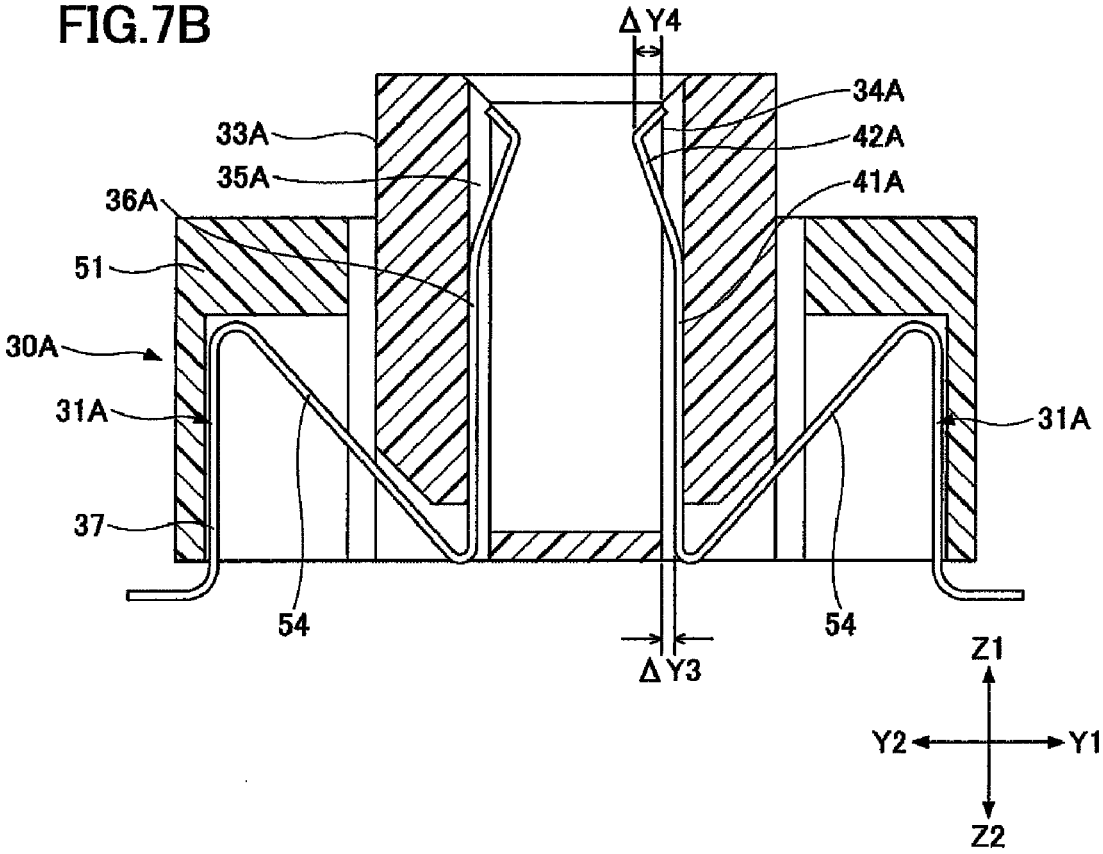
Figure 8:
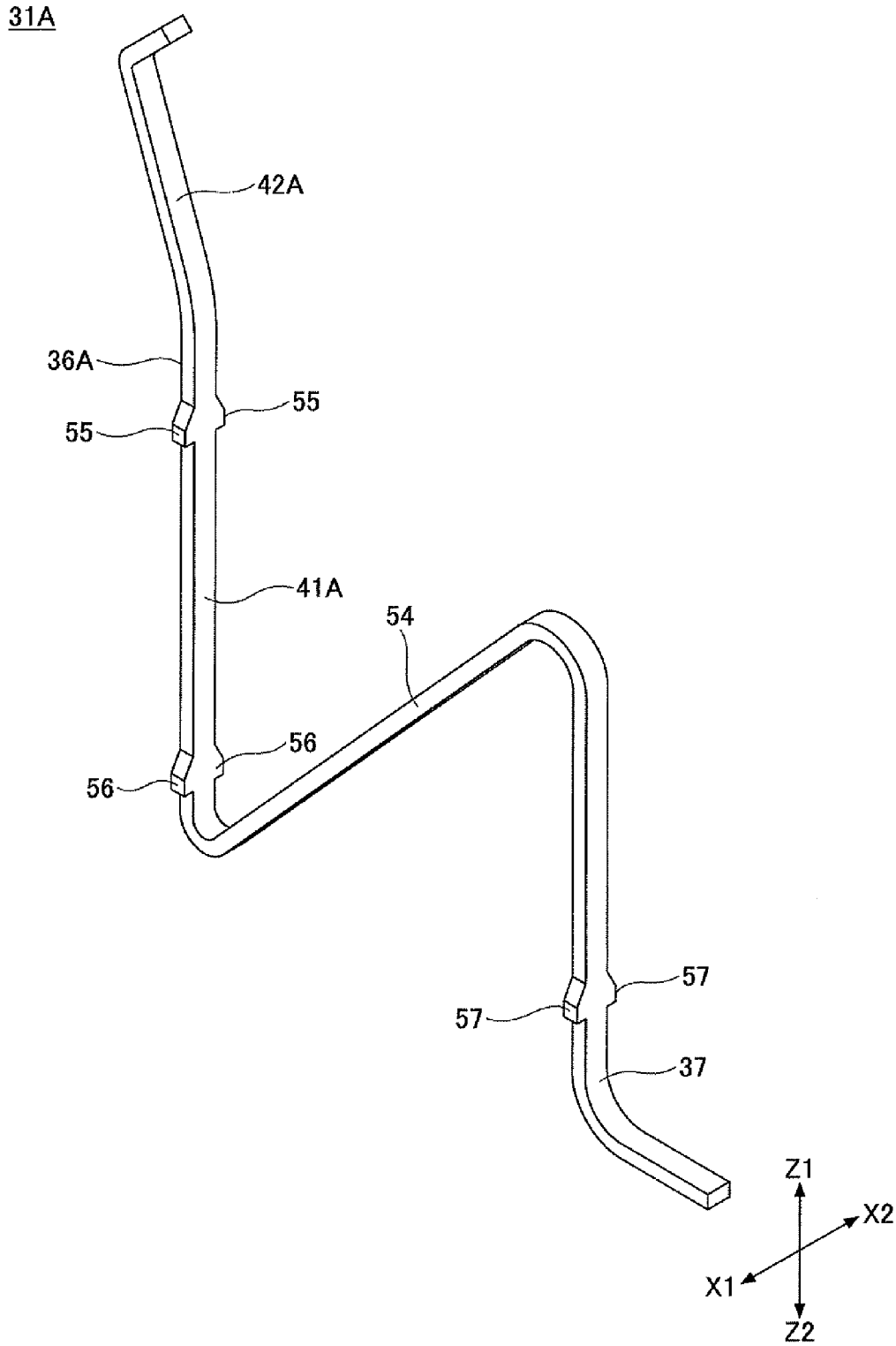
FIG. 8 is a perspective view illustrating a second contact in a state removed from the connector apparatus of FIG. 5.

FIG. 5 is a perspective view of a connector apparatus 200 according to a second embodiment of the present invention in a state before engaging the first connector with the below-described second connector 30A. FIG. 6 is a fragmentary perspective view illustrating a state of the connector apparatus 200 before engaging the first and second connectors 10, 30A. FIGS. 7A and 7B are cross-sectional views illustrating main parts of the connector apparatus 200 of FIG. 5. FIG. 8 is a perspective view illustrating a second contact 31A in a state removed from the connector apparatus 200 of FIG. 5. In FIGS. 5-8, like components are indicated with like reference numerals as those of FIGS. 1, 2A, and 2B and are not further explained.

The connector apparatus 200 includes the first connector 10 and a second connector 30A that are engageable with each other. The second connector 30A is a floating connector capable of absorbing positional deviation with respect to the first connector 10.

First, an exemplary configuration of the second connector 30A is described with reference to FIGS. 5-8.

The second connector 30A includes plural second contacts 31A and a second main body 32A supporting the second contacts 31A. The second contacts 31A are conductive whereas the second main body 32A is insulative.

The second main body 32A includes an engagement part 33A that can detachably engage the first main body 12 and a cylindrical part 51 arranged in a manner encompassing the engagement part 33A.

As illustrated in FIGS. 5 and 6, the engagement part 33A has a rectangular cylindrical shape. The engagement part 33A includes four inner walls (engagement planes) 34A that can be detachably engaged with the first main body 12. Among the four inner walls 34A, the pair of inner walls 34A positioned opposite to each other in the Y1-Y2 direction have plural second groove parts 35A formed at a predetermined interval in the X1-X2 direction.

The second groove parts 35A extend in the Z1-Z2 direction. The depth of the second groove part 35A (length of the second groove part 35A in the Y1-Y2 direction) is substantially uniform. Second connection parts 36A of the second contacts 31A are inserted into corresponding second groove parts 35A one by one from the Z2 direction to the Z1 direction. The second connection part 36A includes a second target support part 41A and a second arm part 42A.

The cylindrical part 51 has a square cylindrical shape. The cylindrical part 51 includes four inner walls (engagement planes) 52 that can be displaced relative to the engagement part 33A in the Y1-Y2 direction. Among the four inner walls 52, the pair of inner walls 52 positioned opposite to each other in the Y1-Y2 direction have plural guide groove parts 53 formed at a predetermined interval in the X1-X2 direction. The below-described second lead parts 37 of the second contact 31A are inserted into corresponding guide groove parts 53 one by one from the Z2 direction to the Z1 direction.

As illustrated in FIGS. 7A-8, the second contact 31A includes a second connection part 36A, the second lead part 37, and an extension part 54. The second contact 31A is to be connected to a corresponding first contact 11. The second lead part 37 is to be connected to a conductor placed on a circuit board by soldering. The extension part 54 is configured to extend and contract in the Y1-Y2 direction between the second connection part 36A and the second lead part 37.

As illustrated in FIGS. 7A-7B, the second connection part 36A has substantially the same shape and size of the first connection part 16 which is to be symmetrically arranged and connected to the second connection part 36A. Because the depth of the second groove parts 35A is substantially uniform, the second target support part 41A and the second arm part 42A have a shape slightly different from those of the above-described second target support part 41 and the second arm part 42 illustrated in FIGS. 1-2B. Nevertheless, because the functions of the second target support part 41A and the second arm part 42A are substantially the same as those of the second target support part 41 and the second arm part 42, a detailed description of the second target support part 41A and the second arm part 42A is omitted.

Engagement claws 55 are integrally formed on both side planes (side of X1 direction or side of X2 direction) of the second target support part 41A. The engagement claws 55 are to be inserted in the second groove parts 35A and pressed against the side planes (plane of X1 side or plane of X2 side) of the second groove parts 35A. The engagement claws 55 prevent the second contacts 31A from disengaging from the second main body 32A.

As illustrated in FIGS. 6-8, the extension part 54, which is formed having substantially an N-letter shape, has two folded parts. By resiliently bending the folded parts, the extension part 54 can extend and contract in the Y1-Y2 direction. Engagement claws 56 are integrally formed to the extension part 54 on the end of the extension part 54 toward the second connection part 36A. The engagement claws 56 are to be inserted in the second groove parts 35A and pressed against the side planes (plane of X1 side or plane of X2 side) of the second groove parts 35A. Engagement claws 57 are integrally formed to the extension part 54 on the end of the extension part 54 toward the second lead part 37. The engagement claws 57 are to be inserted in the guide groove parts 53 and pressed against the side planes (plane of X1 side or plane of X2 side) of the guide groove parts 53.

Thereby, one end part of the extension part 54 is coupled to an engagement part 33A by the engagement claws 56 and the other end part of the extension part 54 is coupled to the cylindrical part 51 by the engagement claws 57. Accordingly, by the extending and contracting of the extension part 54 inside the guide groove parts 53 in the Y1-Y2 direction, the engagement part 33A and the cylindrical part 51 can be displaced relative to each other in the Y1-Y2 direction. Thereby, the positional deviation in the Y1-Y2 direction between the first and second connectors 10, 30A can be absorbed.

The first and second contacts 11, 31A are formed by performing a punching process or a bending process on a conductive metal board. In this embodiment, because the first and second connection parts 16, 36A are formed with substantially the same shape and size, molding of plural types of contacts 11, 31A can be achieved by simply dividing a molding die into die components and replacing one or more die components with another die component(s). Thereby, manufacturing costs can be reduced.

Figure 9:
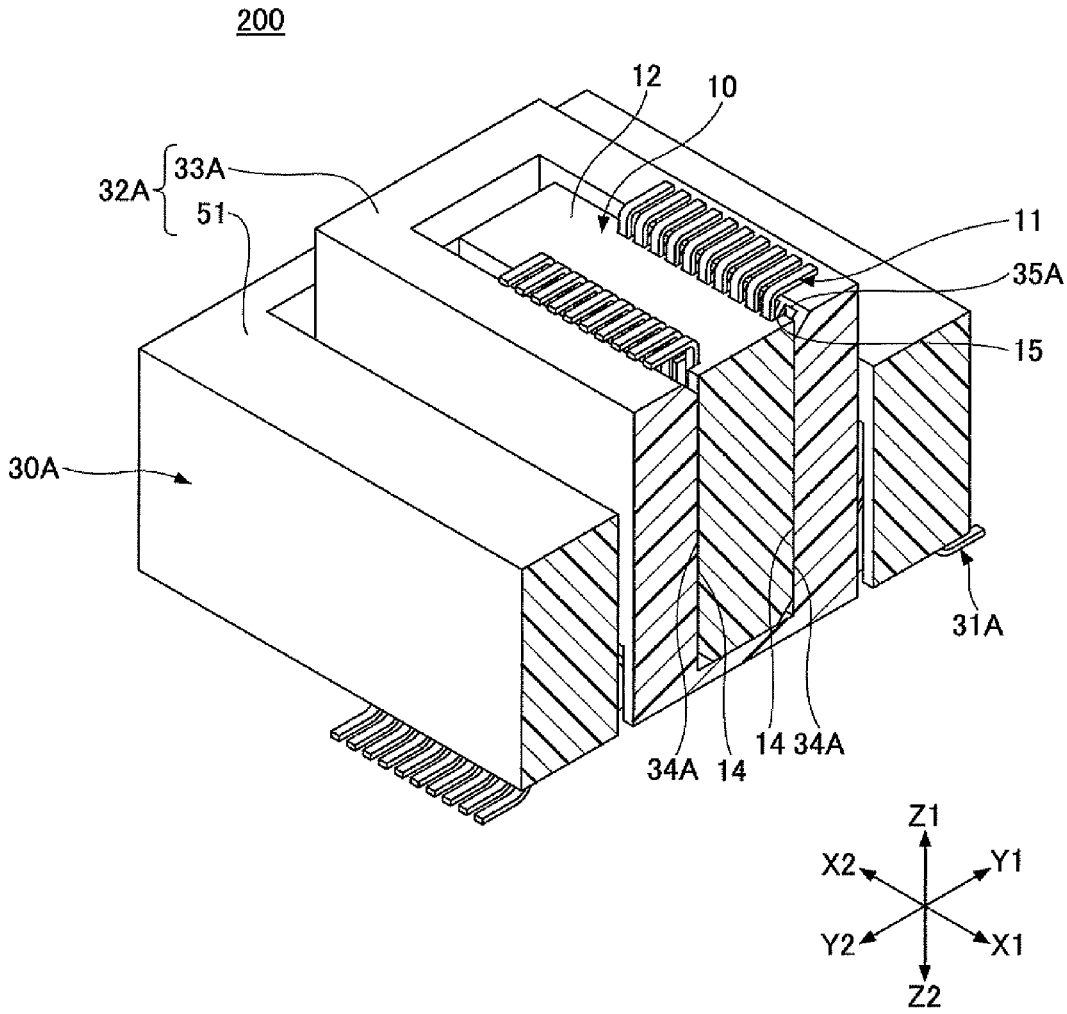
FIG. 9 is a fragmentary perspective view illustrating a state of a connector apparatus after engaging first and second connectors.
Figure 10:
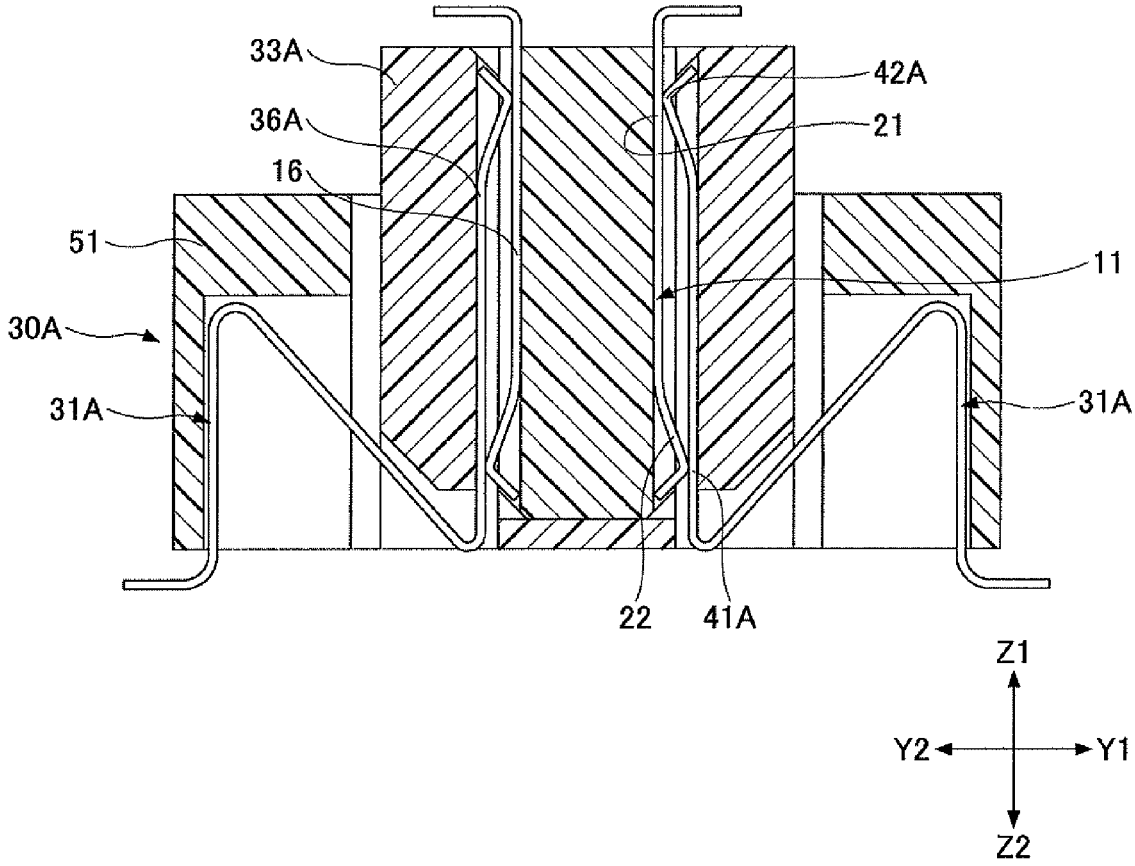
FIG. 10 is a cross-sectional view illustrating a main part of the connector apparatus of FIG. 9.

Next, the movement (operation) of the first and second arm parts 22, 42A in a case of engaging the first and second connectors 10, 30A are described with reference to FIGS. 9 and 10. FIG. 9 is a fragmentary perspective view illustrating a state of the connector apparatus 200 after engaging the first and second connectors 10, 30A. FIG. 10 is a cross-sectional view illustrating a main part of the connector apparatus 200 of FIG. 9.

The first and second main bodies 12, 32A engage when the first and second connectors 10, 30A are engaged. Thereby, plural first contacts 11 are conductively connected to corresponding second contacts 31A.

As illustrated in FIGS. 9 and 10, the first and second arm parts 22, 42A resiliently deform, so that the first arm part 22 resiliently contacts the second target support part 41A and the second arm part 42A resiliently contacts the first target support part 21. Thereby, the first and second connection parts 16, 36A contact at two points (two areas).

With the above-described embodiment of the present invention, the reliability of connection between the first and second connectors 10, 30A can be improved because the first and second connection parts 16, 36A are connected at two points (two areas) when the first and second connectors 10, 30A are engaged. Because the first and second connection parts 16, 36A are formed with substantially the same shape and size, molding of plural types of contacts 11, 31A can be achieved by simply dividing a molding die into die components and replacing one or more die components with another die component(s). Thereby, manufacturing costs can be reduced.

Further, when the first and second connectors 10, 30A engage, the first and second arm parts 22, 42A resiliently deform, so that the first arm part 22 resiliently contacts the second target support part 41A and the second arm part 42A resiliently contacts the first target support part 21. Accordingly, the resilient recovering force of the first and second arm parts 22, 42A increases the contact force between the first and second connection parts 16, 36A. Thereby, the reliability of the connection can be further improved.

Third Embodiment

Figure 11:
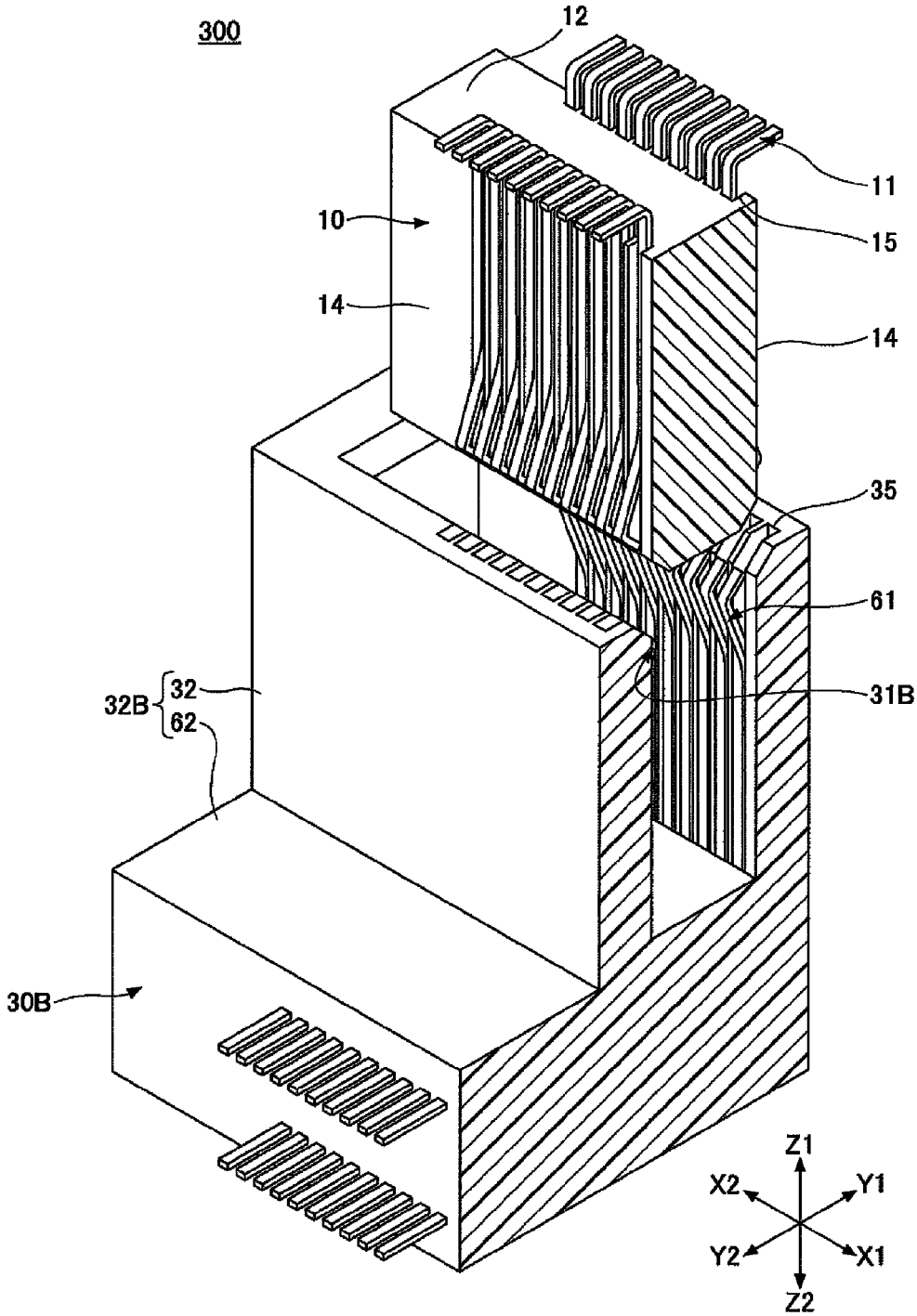
FIG. 11 is a perspective view of a connector apparatus according to a third embodiment of the present invention in a state before engaging a first connector with a second connector.
Figure 12A:
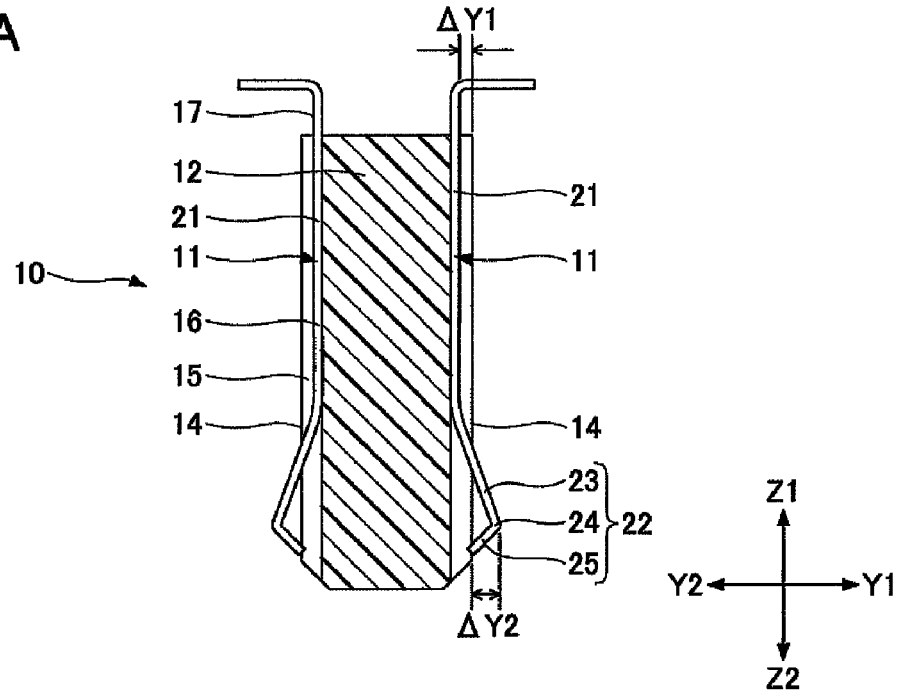
FIGS. 12A and 12B are cross-sectional views illustrating main parts of the connector apparatus of FIG. 11.
Figure 12B:
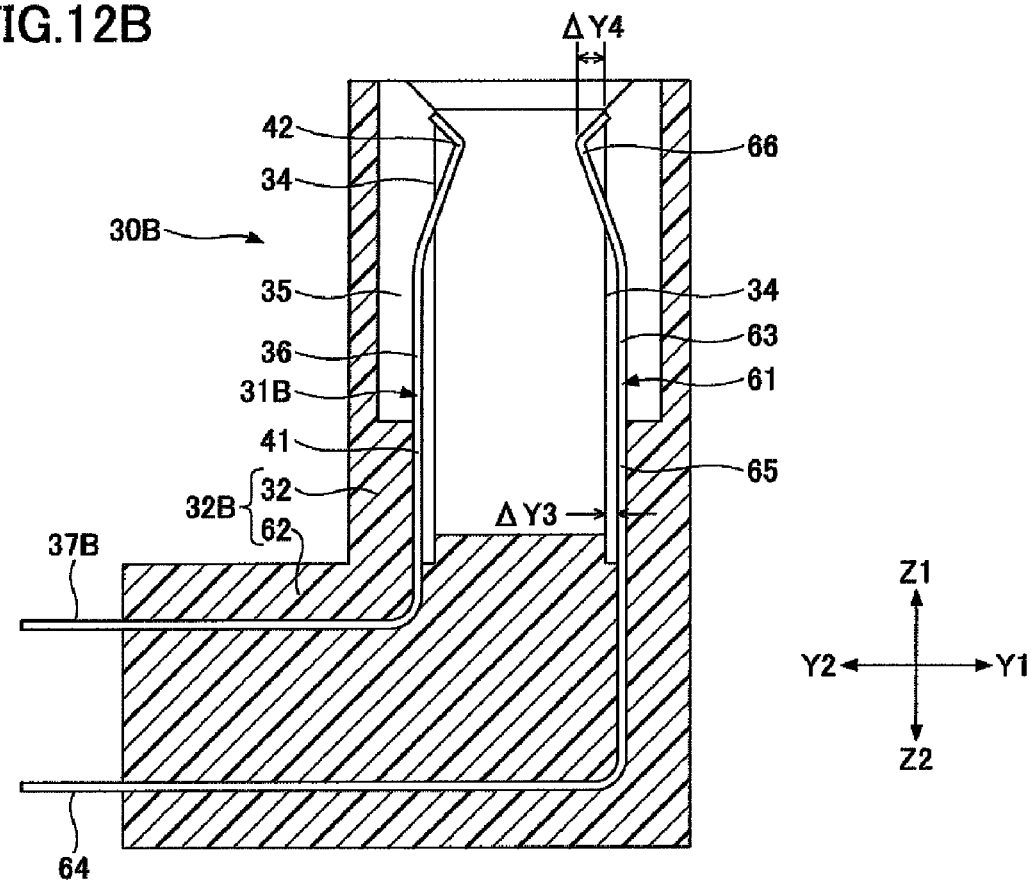

FIG. 11 is a perspective view of a connector apparatus 300 according to a third embodiment of the present invention in a state before engaging the first connector 10 with the below-described second connector 30B. FIGS. 12A and 12B are cross-sectional views illustrating main parts of the connector apparatus 300 of FIG. 11. In FIGS. 11-12B, like components are indicated with like reference numerals as those of FIGS. 1, 2A, and 2B and are not further explained.

The connector apparatus 300 includes the first connector 10 and a second connector 30B that are engageable with each other. The second connector 30B is a right angle connector that can be mounted to a circuit board (not illustrated) in a direction orthogonal to the direction which the first connector 10 is engaged (Z1-Z2 direction).

First, an exemplary configuration of the second connector 30B is described with reference to FIGS. 11, 12A, and 12B.

The second connector 30B includes second and third contacts 31B, 61, and a second main body 32B that supports the second and third contacts 31B, 61. The second and third contacts 31B and 61 are conductive whereas the second main body 32B is insulative.

The second main body 32B has a configuration in which the second main body 32 (illustrated in FIGS. 1-2B) and an elongation part 62 are integrally formed as a united body. The elongation part 62 is elongated from the second main body 32 in a direction (Y1-Y2 direction) orthogonal to the direction of engaging the first contact 10.

The second and third contacts 31B, 61 are arranged opposite to each other. Compared to the pair of second contacts illustrated in FIGS. 1-2B, the second and third contacts 31B, 61 are extended in a direction (Y2 direction in FIG. 12B) orthogonal to the direction of engaging the first contact 10. The pairs of second and third contacts 31B, 61 positioned opposite to each other are for transmitting signals of positive/negative symmetric waveform (i.e. balanced signals). The pairs of second and third contacts 31B, 61 are arranged at a predetermined interval in the X1-X2 direction.

The second contact 31B has an L-letter shape. The second contact 31B includes the second connection part 36 and a second lead part 37B. The second connection part 36 is for connecting to a corresponding first contact 11. The second lead part 37B is to be inserted into a through hole of a circuit board (not illustrated). The portion between the second connection part 36 and the second lead part 37B is buried in the elongation part 62 by insert molding.

As illustrated in FIGS. 12A and 12B, the second connection part 36 has substantially the same shape and size as the first connection part 16. As described above, the second connection part 36 includes the second target support part 41 and the second arm part 42. The second target support part 41 is bonded to the bottom plane (plane of Y2 side) and side plane (plane of X1 side or plane of X2 side) of the second groove part 35 by insert molding. Accordingly, the second target support part 41 is directly supported by the second main body 32B. The second arm part 42 can resiliently bend having the second target support part 41 as a fulcrum of the bending.

As illustrated in FIGS. 12A and 12B, the third contact 61 has an L-letter shape. The third contact 61 includes a third connection part 63 and a third lead part 64. The third connection part 63 is to be connected to a corresponding first contact 11. The third lead part 64 is to be inserted into a through hole of a circuit board (not illustrated). The portion between the third connection part 63 and the third lead part 64 is buried in the elongation part 62 by insert molding.

The third connection part 63 has substantially the same shape and size as the first connection part 16. Similar to the second connection part 36, the third connection part 63 includes a third target support part 65 and a third arm part 66. The third target support part 65 is bonded to the bottom plane (plane of Y1 side) and side plane (plane of X1 side or plane of X2 side) of the second groove part 35 by insert molding. Accordingly, the third target support part 65 is directly supported by the second main body 32B. The third arm part 66 can resiliently bend having the third target support part 65 as a fulcrum of the bending.

The first, second, and third contacts 11, 31B, 61 are formed by performing a punching process or a bending process on a conductive metal board. In this embodiment, because the first, second, and third contacts 11, 31B, 61 are formed with substantially the same shape and size, molding of plural types of contacts 11, 31B, 61 can be achieved by simply dividing a molding die into die components and replacing one or more die components with another die component(s). Thereby, manufacturing costs can be reduced.

Next, the movement (operation) of the first, second, and third arm parts 22, 42, 66 in a case of engaging the first and second connectors 10, 30B according to the third embodiment is described. Because the engaged state between the first and second connectors 10, 30B is substantially the same as that illustrated in FIGS. 3 and 4, drawings of the engaged state are omitted.

The first and second main bodies 12, 32B engage when the first and second connectors 10, 30B are engaged. Thereby, plural first contacts 11 are conductively connected to corresponding second or third contacts 31B, 61.

In this state, the first and second arm parts 22, 42A resiliently deform, so that the first arm part 22 resiliently contacts the second target support part 41 and the second arm part 42 resiliently contacts the first target support part 21. In addition, the first and third arm parts 22, 66 resiliently deform, so that the first arm part 22 resiliently contacts the third target support part 65 and the third arm part 66 resiliently contacts the first target support part 21. Thereby, in addition to the first and second connection parts 16, 36 contacting at two points (two areas), the first and third connection parts 16, 63 also contact at two points (two areas).

With the above-described embodiment of the present invention, not only the reliability of connection between the first and third connectors 10, 30A is improved but also the reliability of connection between the first and second connection parts 16, 63 is improved because the first and second connection parts 16, 36 are connected at two points (two areas) in addition with the first and third connection parts 16, 63 being connected at two points (two areas). Further, because the first, second, and third connection parts 16, 36, 63 are formed with substantially the same shape and size, molding of plural types of contacts 11, 31B, 61 can be achieved by simply dividing a molding die into die components and replacing one or more die components with another die component(s). Thereby, manufacturing costs can be reduced.

Further, when the first and second connectors 10, 30B engage, the first and second arm parts 22, 42 resiliently deform, so that the first arm part 22 resiliently contacts the second target support part 41 and the second arm part 42 resiliently contacts the first target support part 21. In addition, when the first and second connectors 10, 30B engage, the first and third arm parts 22, 66 resiliently deform, so that the first arm part 22 resiliently contacts the third target support part 65 and the third arm part 66 resiliently contacts the first target support part 21. Accordingly, the resilient recovering force of the first, second, and third arm parts 22, 42, 66 increases the bond between the first and second connection parts 16, 36 (and also the bond between the first and third connection parts 16, 63). Thereby, reliable connection can be further improved.

Although the pair of second and third contacts 31B, 61 opposite to each other in the Y1-Y2 direction of the above-described embodiment of the present invention are for transmitting balanced signals, the pair of second and third contacts 31B, 61 may transmit other signals.

Further, ground planes may be arranged between adjacent contacts 11, 31B, and 61 for preventing cross-talk.

Fourth Embodiment

Figure 13:
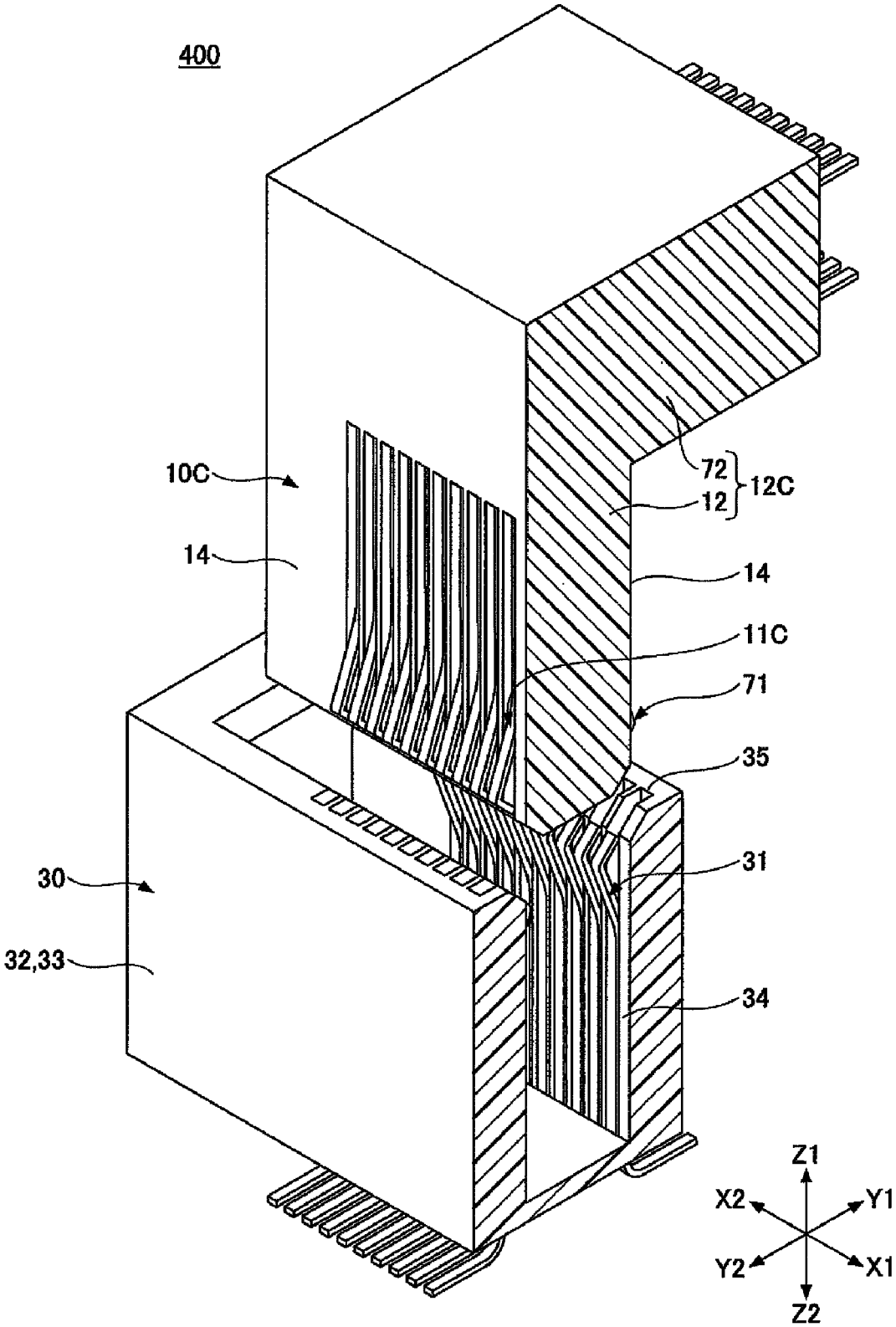
FIG. 13 is a perspective view of a connector apparatus 400 according to a fourth embodiment of the present invention in a state before engaging a first connector to a second connector.
Figure 14A:
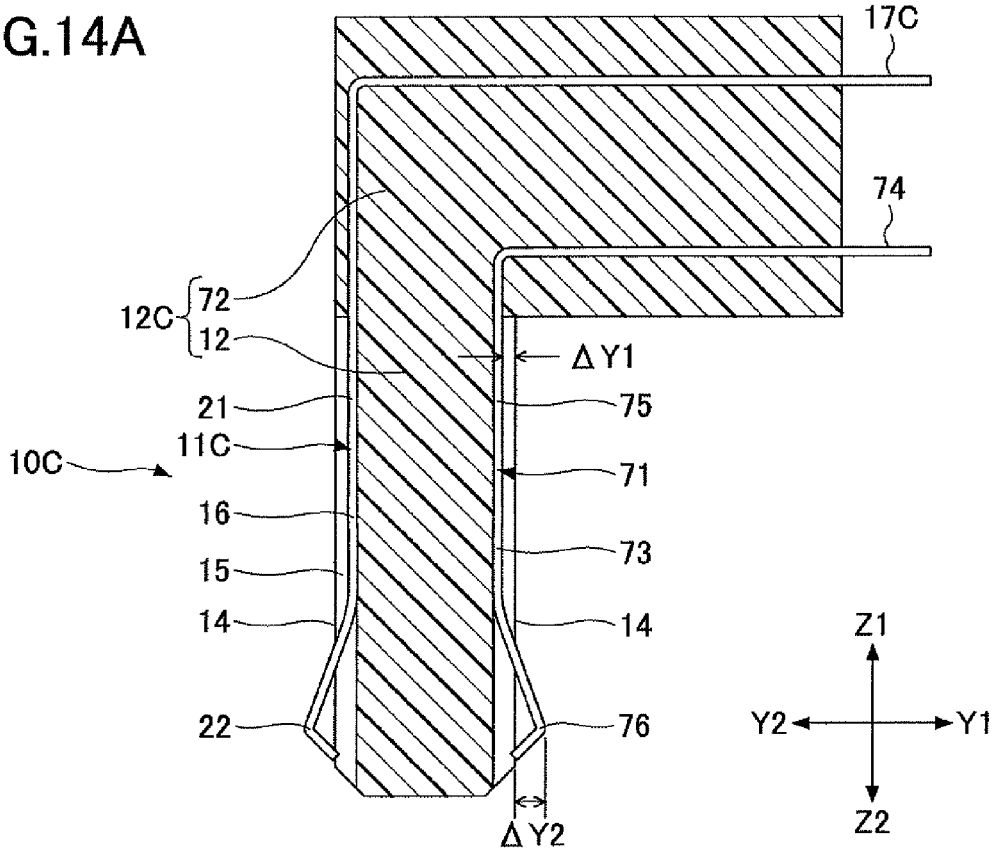
FIGS. 14A and 14B are cross-sectional views illustrating main parts of the connector apparatus of FIG. 13.
Figure 14B:
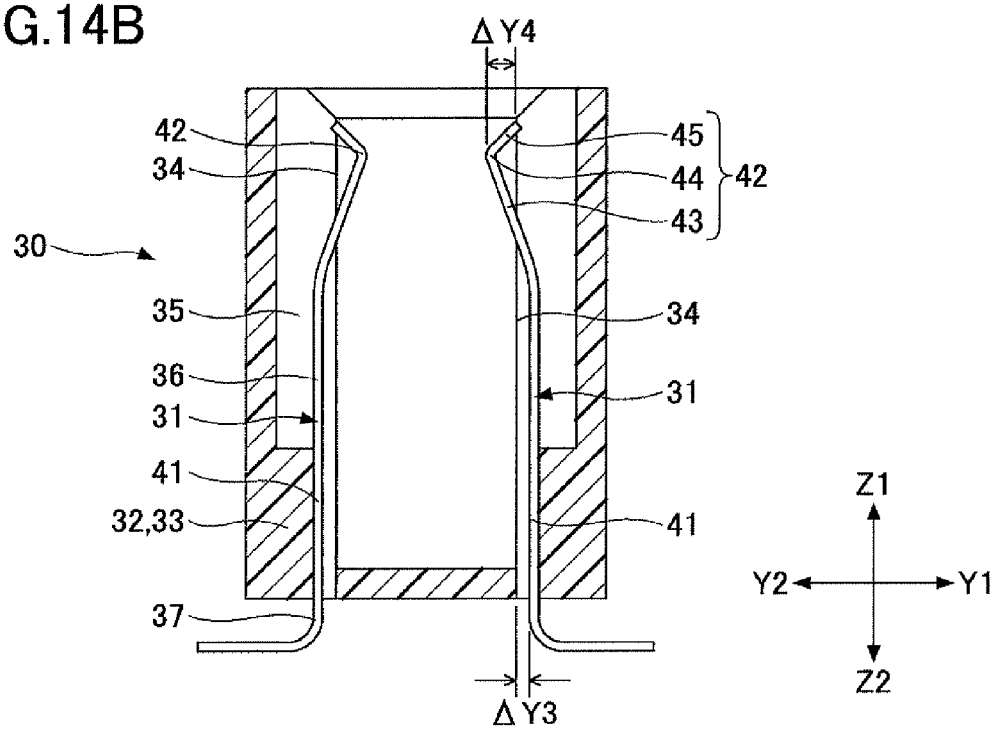

FIG. 13 is a perspective view of a connector apparatus 400 according to a fourth embodiment of the present invention in a state before engaging a first connector 100 to the below-described second connector 30. FIGS. 14A and 14B are cross-sectional views illustrating main parts of the connector apparatus 400 of FIG. 13. In FIGS. 13-14B, like components are indicated with like reference numerals as those of FIGS. 1, 2A, and 2B and are not further explained.

The connector apparatus 400 includes the first connector 10C and the second connector 30 that are engageable with each other. The first connector 10C is a right angle connector that can be mounted to a circuit board (not illustrated) in a direction orthogonal to the direction which the first connector 100 is engaged (Z1-Z2 direction).

First, an exemplary configuration of the first connector 10C is described with reference to FIGS. 13, 14A, and 14B.

The first connector 10C includes first and third contacts 11C, 71, and a first main body 12C that supports the first and third contacts 11C, 71. The first and third contacts 11C and 71 are conductive whereas the first main body 12C is insulative.

The first main body 12C has a configuration in which the first main body 12 (illustrated in FIGS. 1-2B) and an elongation part 72 are integrally formed as a united body. The elongation part 72 is elongated from the portion corresponding to the first main body 12 in a direction (Y1 direction in FIG. 14A) orthogonal to the direction of engaging the second connector 30.

The first and third contacts 11C, 71 are arranged opposite to each other. Compared to the pair of first contacts 11 illustrated in FIGS. 1-2B, the first and third contacts 11C, 71 are extended in a direction (Y1 direction in FIG. 14A) orthogonal to the direction of engaging the second connector 30. The pairs of first and third contacts 11C, 71 positioned opposite to each other are for transmitting signals of positive/negative symmetric waveforms (i.e. balanced signals). The pairs of first and third contacts 11C, 71 are arranged at a predetermined interval in the X1-X2 direction.

The first contact 11C has an L-letter shape. The first contact 11C includes the first connection part 16 and a first lead part 17C. The first connection part 16 is for connecting to a corresponding second contact 31. The first lead part 17C is to be inserted into a through hole of a circuit board (not illustrated). The portion between the first connection part 16 and the first lead part 17C is buried in the elongation part 72 by insert molding.

As illustrated in FIGS. 14A and 14B, the first connection part 16 substantially has the same shape and size as the second connection part 36. As described above, the first connection part 16 includes the first target support part 21 and the first arm part 22. The first target support part 21 is bonded to the bottom plane (plane of Y1 side) and side plane (plane of X1 side or plane of X2 side) of the first groove part 15 by insert molding. Accordingly, the first target support part 21 is directly supported by the first main body 120. The first arm part 22 can resiliently bend having the first target support part 21 as a fulcrum of the bending.

As illustrated in FIGS. 14A and 14B, the third contact 71 has an L-letter shape. The third contact 71 includes a third connection part 73 and a third lead part 74. The third connection part 73 is to be connected to a corresponding second contact 31. The third lead part 74 is to be inserted into a through hole of a circuit board (not illustrated). The portion between the third connection part 73 and the third lead part 74 is buried in the elongation part 72 by insert molding.

The third connection part 73 has substantially the same shape and size as the first connection part 16. Similar to the first connection part 16, the third connection part 73 includes a third target support part 75 and a third arm part 76. The third target support part 75 is bonded to the bottom plane (plane of Y1 side) and side plane (plane of X1 side or plane of X2 side) of the first groove part 15 by insert molding. Accordingly, the third target support part 75 is directly supported by the first main body 12C. The third arm part 76 can resiliently bend having the third target support part 75 as a fulcrum of the bending.

The first, second, and third contacts 11C, 31, 71 are formed by performing a punching process or a bending process on a conductive metal board. In this embodiment, because the first, second, and third connection parts 16, 36, 73 are formed with substantially the same shape and size, molding of plural types of contacts 11C, 31, 71 can be achieved by simply dividing a molding die into die components and replacing one or more die components with another die component(s). Thereby, manufacturing costs can be reduced.

Next, the movement (operation) of the first, second, and third arm parts 22, 42, 76 in a case of engaging the first and second connectors 10C, 30 according to the fourth embodiment is described. Because the engaged state between the first and second connectors 10C, 30 is substantially the same as that illustrated in FIGS. 3 and 4, drawings of the engaged state are omitted.

The first and second main bodies 12C, 32 engage when the first and second connectors 10C, 30 are engaged. Thereby, plural first and third contacts 11C, 71 are conductively connected to corresponding second contacts 31.

In this state, the first and second arm parts 22, 42 resiliently deform, so that the first arm part 22 resiliently contacts the second target support part 41 and the second arm part 42 resiliently contacts the first target support part 21. In addition, the second and third arm parts 42, 76 resiliently deform, so that the second arm part 42 resiliently contacts the third target support part 75 and the third arm part 76 resiliently contacts the second target support part 41. Thereby, in addition to the first and second connection parts 16, 36 contacting at two points (two areas), the second and third connection parts 36, 73 also contact at two points (two areas).

With the above-described embodiment of the present invention, reliability of connection is improved because the first and second connection parts 16, 36 are connected at two points (two areas) in addition with the second and third connection parts 36, 73 being connected at two points (two areas). Further, because the first, second, and third connection parts 16, 36, 73 are formed with substantially the same shape and size, molding of plural types of contacts 11C, 31, 71 can be achieved by simply dividing a molding die into die components and replacing one or more die components with another die component(s). Thereby, manufacturing costs can be reduced.

Further, when the first and second connectors 10C, 30 engage, the first and second arm parts 22, 42 resiliently deform, so that the first arm part 22 resiliently contacts the second target support part 41 and the second arm part 42 resiliently contacts the first target support part 21. In addition, when the first and second connectors 10C, 30 engage, the second and third arm parts 42, 76 resiliently deform, so that the second arm part 42 resiliently contacts the third target support part 75 and the third arm part 76 resiliently contacts the second target support part 41. Accordingly, the resilient recovering force of the first, second, and third arm parts 22, 42, 76 increases the bond between the first and second connection parts 16, 36 (and also the bond between the second and third connection parts 36, 73). Thereby, reliable connection can be further improved.

Although the pair of first and third contacts 11C, 71 opposite to each other in the Y1-Y2 direction of the above-described embodiment of the present invention are for transmitting balanced signals, the pair of first and third contacts 11C, 71 may transmit other signals.

Further, ground planes may be arranged between adjacent contacts 11C, 31, and 71 for preventing cross-talk.

Fifth Embodiment

Figure 15:
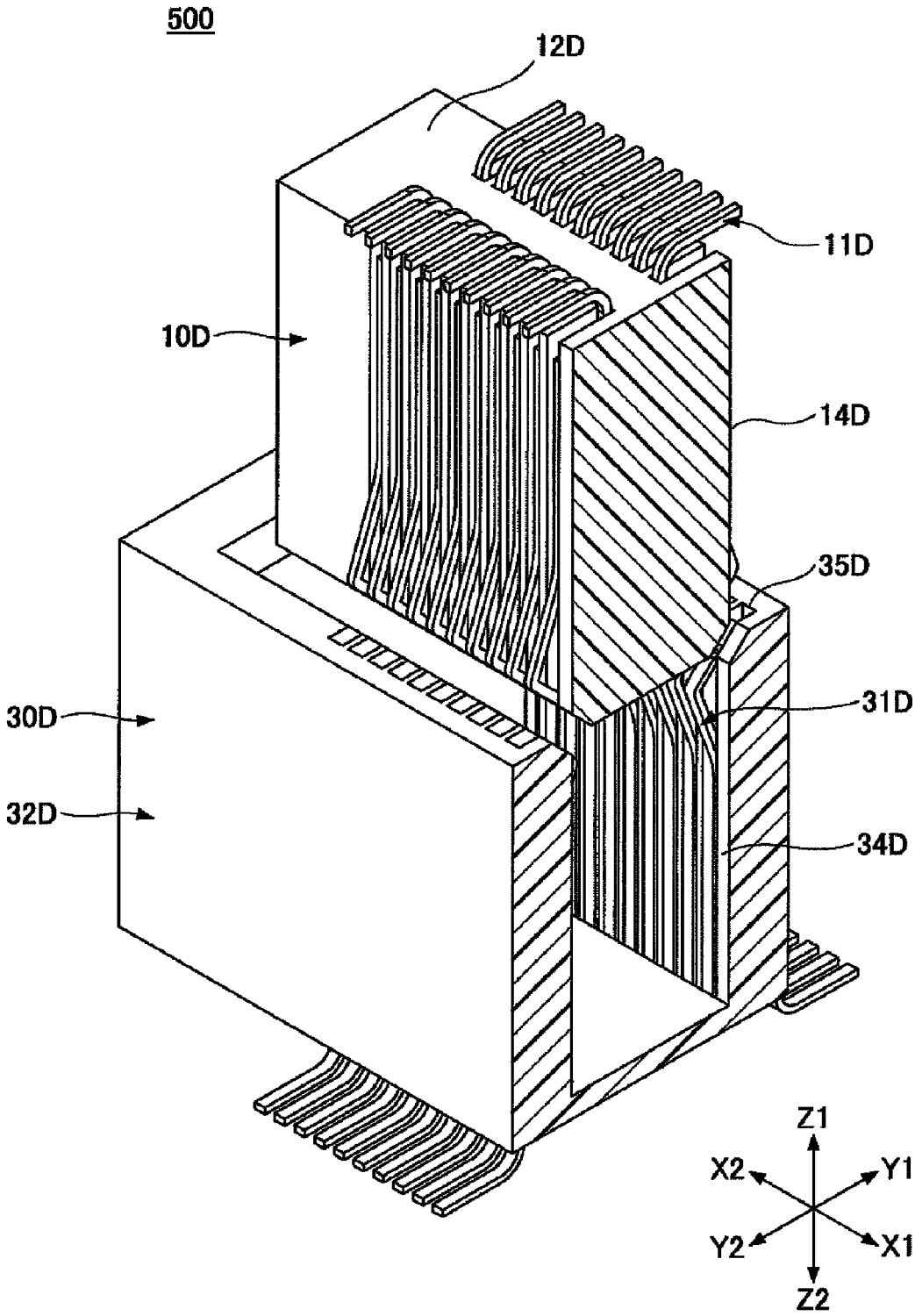
FIG. 15 is a perspective view of a connector apparatus 500 according to a fifth embodiment of the present invention in a state before engaging a first connector with a second connector.
Figure 16A:
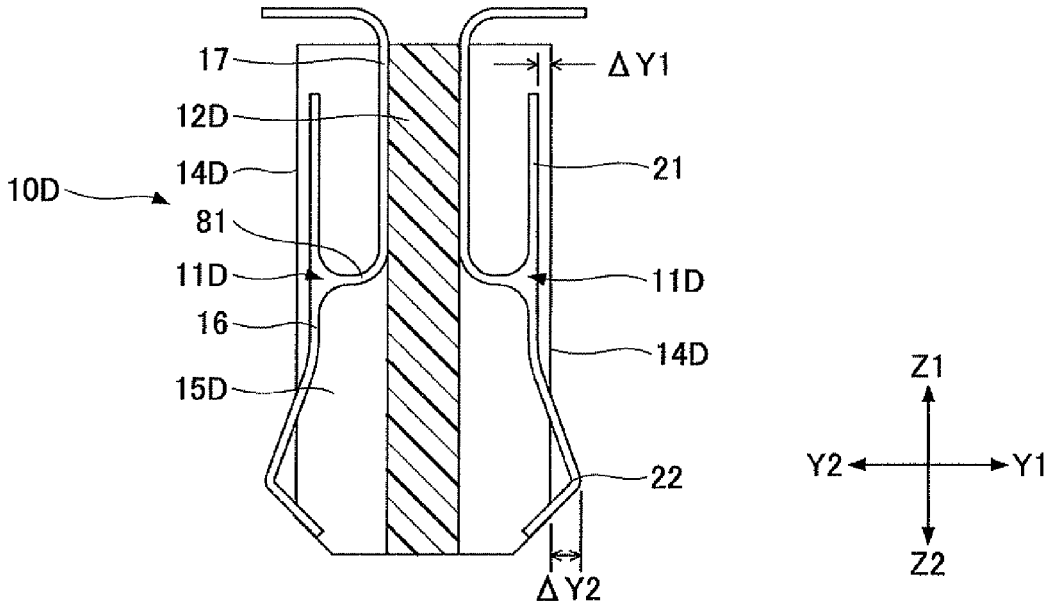
FIGS. 16A and 16B are cross-sectional views illustrating main parts of the connector apparatus of FIG. 15.
Figure 16B:
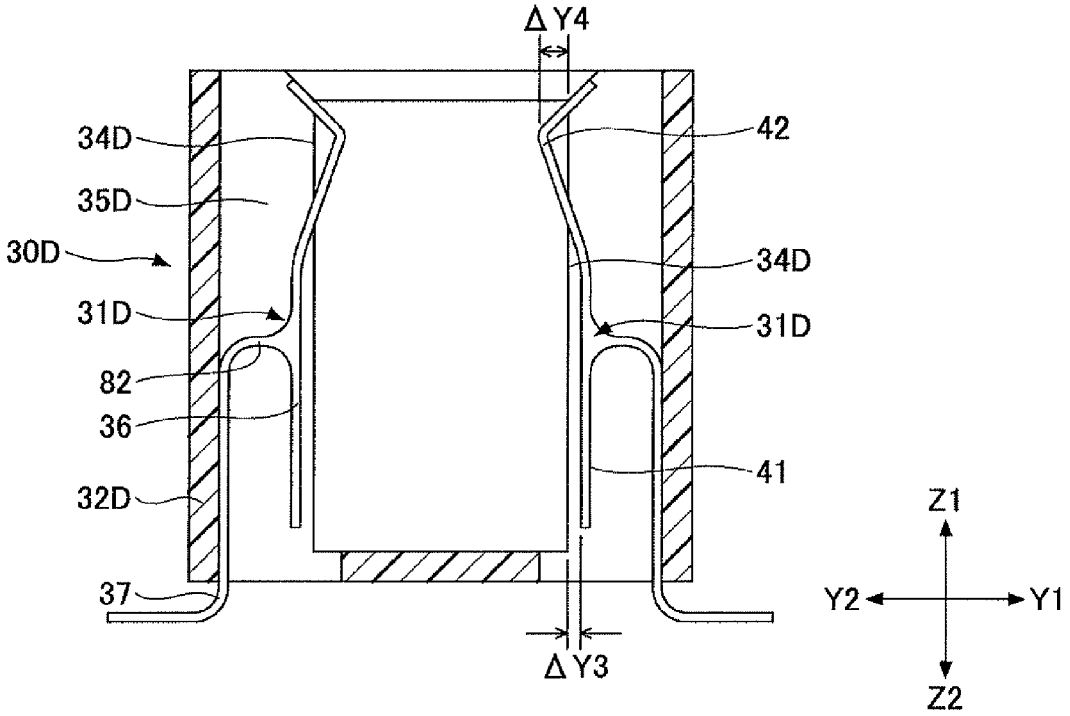
Figure 17:
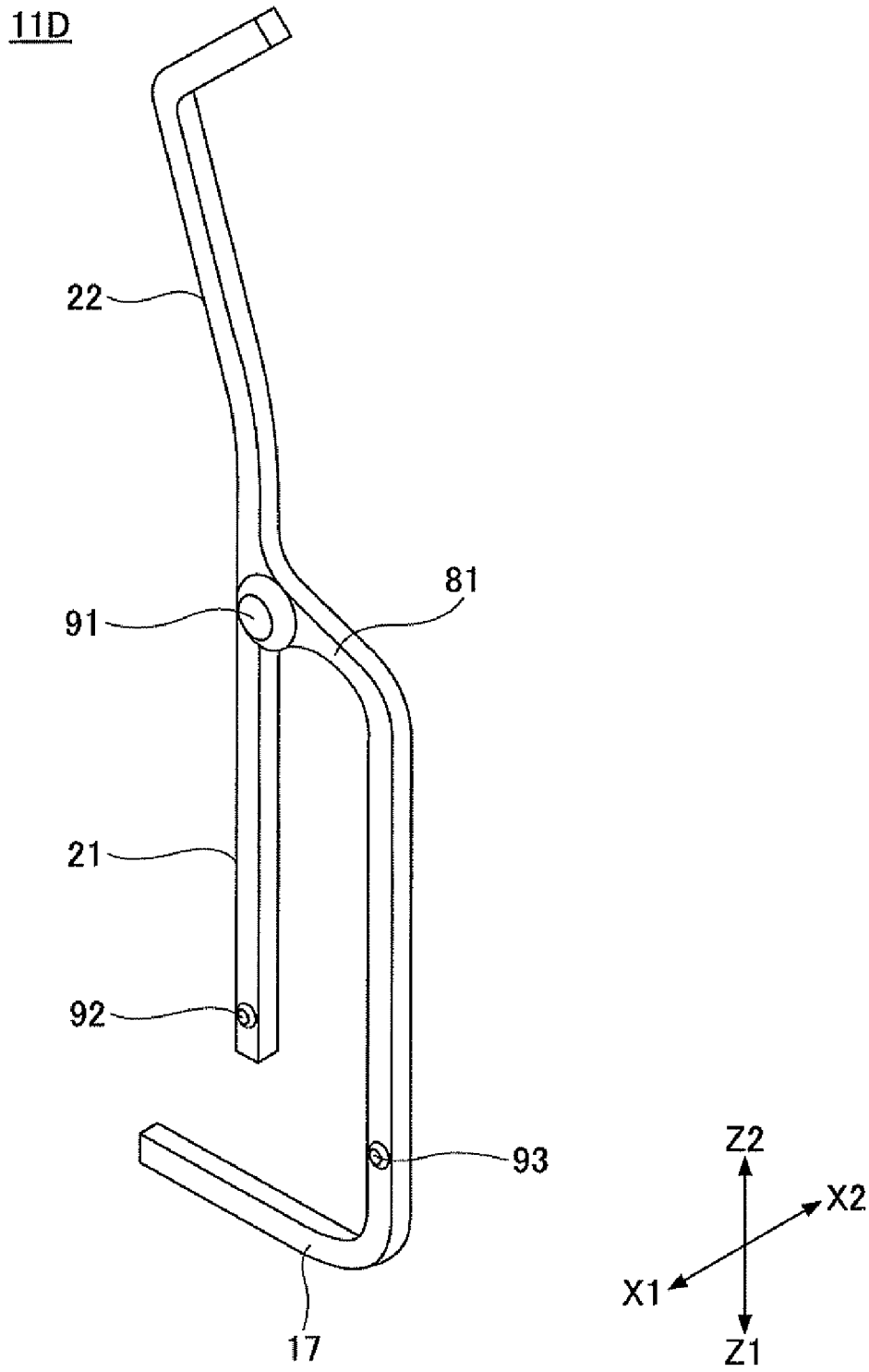
FIG. 17 is a perspective view illustrating a first contact in a state removed from the connector apparatus of FIG. 15.

FIG. 15 is a perspective view of a connector apparatus 500 according to a fifth embodiment of the present invention in a state before engaging a first connector 10D with a second connector 30D. FIGS. 16A and 16B are cross-sectional views illustrating main parts of the connector apparatus 500 of FIG. 15. FIG. 17 is a perspective view illustrating a first contact 11D in a state removed from the connector apparatus 500 of FIG. 15. In FIGS. 15-17, like components are indicated with like reference numerals as those of FIGS. 1, 2A, and 2B and are not further explained.

The connector apparatus 500 includes the first connector 10D and the second connector 30D that are engageable with each other.

First, an exemplary configuration of the first connector 10D is described with reference to FIGS. 15-17.

The first connector 10D includes plural first contacts 11D and a first main body 12D that supports the first contacts 11D. The first contact 11D is conductive whereas the first main body 12D is insulative.

The first main body 12D has a first groove part 15D having a depth (length in Y1-Y2 direction) greater than the first groove part 15 of the first main body 12 illustrated in FIGS. 1, 2A, and 2B.

As illustrated in FIGS. 16A and 16B, the first contact 11D includes the first connection part 16, the first lead part 17, and a first joint part 81. The first connection part 16 is to be connected to a corresponding second contact 31D. The first lead part 17 is to be connected to a conductor placed on a circuit board by soldering. The first joint part 81 is configured to connect the first connection part 16 and the first lead part 17.

The first joint part 81 has an L-letter shape. The first joint part 81 is integrally formed with the first lead part 17 in a manner where one end of the first joint part 81 continues to a Z2 end of the first lead part 17. The first joint part 81 is also integrally formed with the first connection part 16 in a manner where the other end of the first joint part 81 perpendicularly intersects with a midsection of the first connection part 16 in the longitudinal direction of the first connection part 16 (Z2 end part of the first target support part 21). As described below, engagement claws 91 are integrally formed on a portion connecting the other end of the first joint part 81 and the Z2 end part of the first target support part 21. The engagement claws 91 are provided on both sides (side of X1 direction and side of X2 direction) of the portion connecting the other end of the first joint part 81 and the Z2 end part of the first target support part 21. The engagement claws 91 on both sides are to be inserted into corresponding first groove parts 15D and pressed against a side plane (plane of X2 side and plane of X1 side) of the first groove parts 15D.

The first connection part 16 has a configuration having the first target support part 21 and the first arm part 22 integrated into a united body. The first target support part 21 is indirectly supported by the first main body 12D. That is, the first target support part 21 is supported by the first main body 12D via the first joint part 81. The first target support part 21 is buried in the first main body 12D in an amount (distance) of ΔY1 with respect to an engagement plane 14D.

The engagement claw 91 and an engagement claw 92 are integrally formed with the Z2 end part and a Z1 end part of the first target support part 21, respectively. The engagement claws 91, 92 are formed on each side (X1 side and X2 side) of the first target support part 21. The engagement claws 91, 92 support both ends of the first target support part 21 for preventing deformation of the first target support part 21.

Although the engagement claw 91 is provided to the first target support part 21, the engagement claw 91 may be omitted. For example, the first joint part 81 can cooperate with the engagement claw 92 and support both ends of the first target support part 21 for preventing deformation of the first target support part 21.

In a case where an external force is applied to the first arm part 22, the first arm part 22 resiliently bends where the first joint part 81 serves as a fulcrum of the bending. In this embodiment, the first joint part 81 causes the first arm part 22 to protrude (float) from the bottom plane of the first groove part 15D.

Further, engagement claws 93 are integrally formed with the first lead part 17. The engagement claws 93 are provided on both sides (side of X1 direction and side of X2 direction) of the first lead part 17. The engagement claw 93 on each side is to be inserted into a corresponding first groove part 15D and pressed against a side plane (plane of X2 side and plane of X1 side) of the first groove part 15D.

Accordingly, the engagement claws 91-93 prevent the first contact 11D from disengaging from the first main body 12D.

Next, an exemplary configuration of the second connector 300 is described with reference to FIGS. 15, 16A, and 16B.

The second connector 300 includes plural second contacts 31D and a second main body 32D that supports the second contacts 31D. The second contact 31D is conductive whereas the second main body 32D is insulative.

The second main body 32D has a second groove part 35D having a depth (length in Y1-Y2 direction) greater than the second groove part 35 of the second main body 32 illustrated in FIGS. 1, 2A, and 2B.

The second contact 31D is configured having the second connection part 36 protrude (float) from the bottom plane (plane of Y1 side or plane of Y2 side) of the second groove part 35D.

As illustrated in FIGS. 16A and 16B, the second contact 31D includes the second connection part 36, the second lead part 37, and a second joint part 82. The second connection part 36 is to be connected to a corresponding first contact 11D. The second lead part 37 is to be connected to a conductor placed on a circuit board by soldering. The second joint part 82 is configured to connect the second connection part 36 and the second lead part 37.

The second joint part 82 has an L-letter shape. The second joint part 82 is integrally formed with the second lead part 37 in a manner where one end of the second joint part 82 continues to a Z1 end of the second lead part 37. The second joint part 82 is also integrally formed with the second connection part 36 in a manner where the other end of the second joint part 82 perpendicularly intersects with a midsection of the second connection part 36 in the longitudinal direction of the second connection part 36 (Z1 end part of the second target support part 41). As described below, engagement claws (not illustrated, hereinafter referred to as "first engagement claws of the second target support part 41") are integrally formed with a portion connecting the other end of the second joint part 82 and the Z1 end part of the second target support part 41. The first engagement claws of the second target support part 41 are provided on both sides (side of X1 direction and side of X2 direction) of the portion connecting the other end of the second joint part 82 and the Z1 end part of the second target support part 41. First engagement claws of the second target support part 41 on both sides are to be inserted into corresponding second groove parts 35D and pressed against side planes (plane of X2 side and plane of X1 side) of the second groove part 35D.

The second connection part 36 has a configuration having the second target support part 41 and the second arm part 42 integrated into a united body. The second target support part 41 is indirectly supported by the second main body 32D. That is, the second target support part 41 is supported by the second main body 32D via the second joint part 82. The second target support part 41 is buried in the second main body 32D in an amount (distance) of ΔY3 with respect to an engagement plane 34D.

In addition to the first engagement claws of the second target support part 41, second engagement claws (hereinafter referred to as "second engagement claws of the second target support part 41") are integrally formed with a Z2 end part of the second target support part 41.

The second engagement claws of the second target support part 41 are formed on each side (X1 side and X2 side) of the second target support part 41. Accordingly, the first and second engagement claws of the second target support part 41 support both ends of the second target support part 41 for preventing deformation of the second target support part 41.

Although the first engagement claws are provided to the first target support part 21, the first engagement claws may be omitted. For example, the second joint part 82 can cooperate with the second engagement claws and support both ends of the second target support part 41 for preventing deformation of the second target support part 41.

In a case where external force is applied to the second arm part 42, the second joint part 82 resiliently bends where the second joint part 82 serves as a fulcrum of the bending. In this embodiment, the second joint part 82 causes the second arm part 42 to protrude (float) from the bottom plane of the second groove part 35D.

Further, third engagement claws (not illustrated) are integrally formed with the second lead part 37. The third engagement claws are provided on both sides (side of X1 direction and side of X2 direction) of the second lead part 37. The third engagement claws on both sides are to be inserted into corresponding second groove parts 35D and pressed against a side plane (plane of X2 side and plane of X1 side) of the second groove part 35D. The third engagement claws prevent the second contact 31D from disengaging from the second main body 32D.

The first and second contacts 11D, 31D are formed by performing a punching process or a bending process on a conductive metal board. In this embodiment, because the first and second contacts 11D, 31D are formed with substantially the same shape and size, plural different types of molds are not necessary. Thus, manufacturing costs can be reduced. Further, because the first and second contacts 11D, 31D are formed with substantially the same shape and size, plural different types are not required to be managed (handled). Thus, managing (handling) costs can also be reduced.

Figure 18:
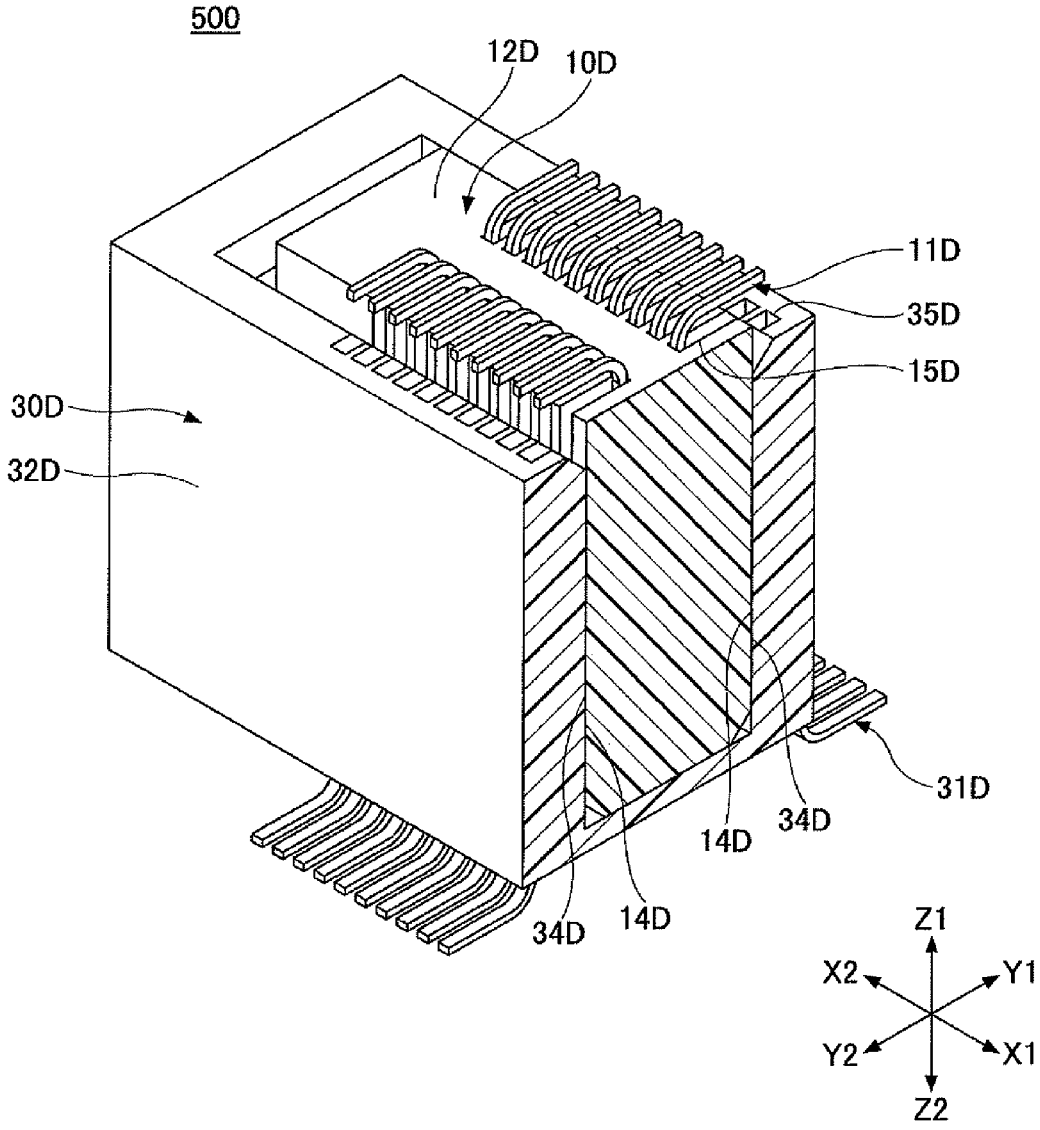
FIG. 18 is a fragmentary perspective view illustrating a state of the connector apparatus of FIG. 15 after engaging first and second connectors.
Figure 19:
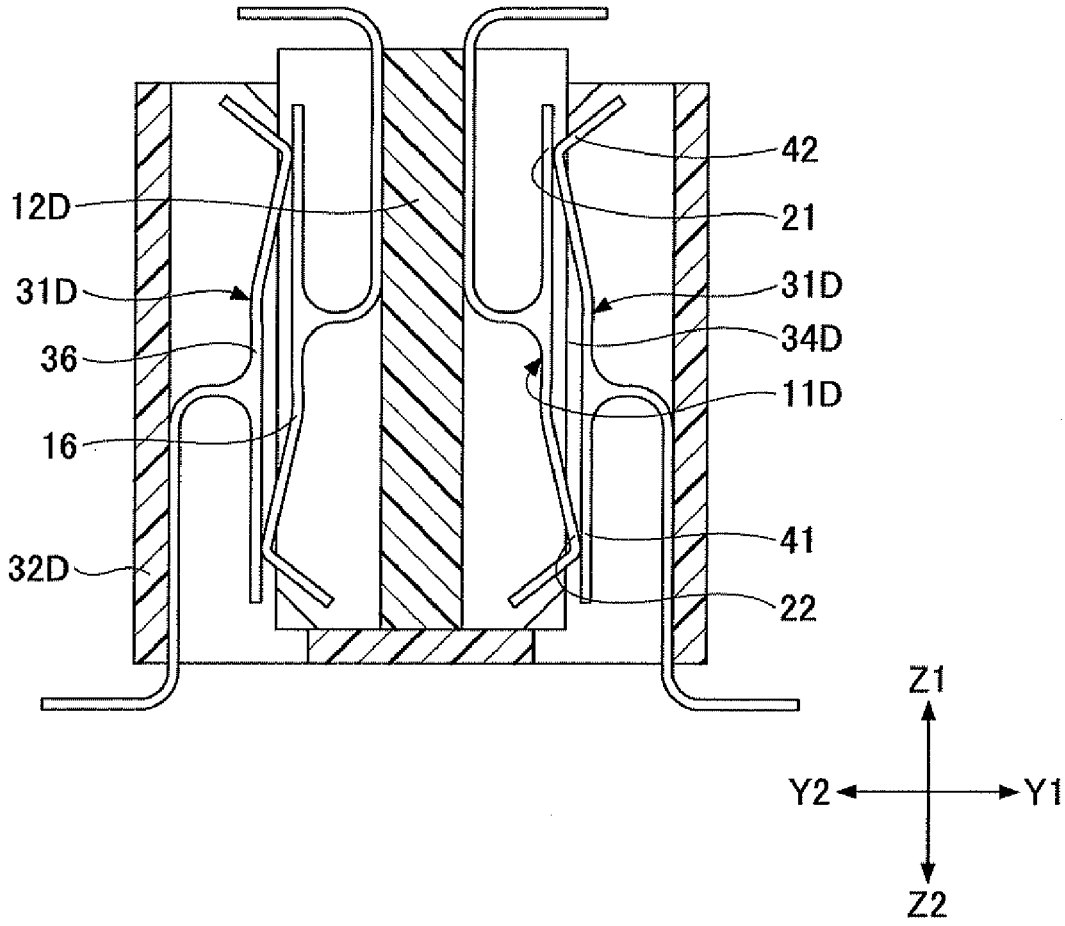
FIG. 19 is a cross-sectional view illustrating a main part of the connector apparatus 500 of FIG. 18.

Next, the movement (operation) of the first and second arm parts 22, 42 in a case of engaging the first and second connectors 10D, 30D are described with reference to FIGS. 18 and 19. FIG. 18 is a fragmentary perspective view illustrating a state of the connector apparatus 500 after engaging the first and second connectors 10D, 30D. FIG. 19 is a cross-sectional view illustrating a main part of the connector apparatus 500 of FIG. 18.

The first and second main bodies 12D, 32D engage when the first and second connectors 10D, 30D are engaged. Thereby, plural first contacts 11D are conductively connected to corresponding second contacts 31D.

In this state, the first and second arm parts 22, 42 resiliently deform, so that the first arm part 22 resiliently contacts the second target support part 41 and the second arm part 42 resiliently contacts the first target support part 21. Thereby, the first and second connection parts 16, 36 contact at two points (two areas).

With the above-described embodiment of the present invention, the reliability of connection between the first and second connectors 10D, 30D can be improved because the first and second connection parts 16, 36 are connected at two points (two areas) when the first and second connectors 10D, 30D are engaged. Further, different types of molding dies are not required because the first and second contacts 11D, 31D are formed having substantially the same shape and size. Therefore, manufacturing costs can be reduced. Further, plural types of contacts are not required to be managed (handled) because the first and second contacts 11D, 31D are formed having substantially the same shape and size. Therefore, management (handling) costs can be reduced.

With the above-described embodiment of the present invention, the first arm part 22 resiliently deforms and contacts the second target support part 41 and the second arm part 42 resiliently deforms and contacts the first target support part 21 by engaging the first and second connectors 10D, 30D. Accordingly, the resilient recovering force of the first and second arm parts 22, 42 improves the contact between the first and second connection parts 16, 36. Thus, the connection between the first and second connection parts 16, 36 can be more reliable.

In this embodiment, because the first arm part 22 (second arm part 42) is configured to protrude (float) from the bottom plane of the first groove part 15D (second groove part 35D), the first arm part 22 (second arm part 42) can be set with a large amount of resilient deformation. Thereby, a large amount of resilient deformation during engagement of the first and second connectors 10D and 30D can be set. Thus, the contact between the first and second connectors 10D and 30D can be improved.

It is to be noted that, although the first connector 10D (second connector 30D) is mounted (fixed) on a circuit board in the above-described embodiment of the present invention, the first connector 10D (second connector 30D) may be mounted (fixed) on other devices and apparatuses. For example, the first connector 15 (second connector 30D) may be a floating connector for absorbing positional deviation with respect to the second connector 30D (first connector 10D).

Further, the present invention is not limited to these embodiments, but variations and modifications may be made without departing from the scope of the present invention.

The present application is based on Japanese Priority Application No. 2009-122501 filed on May 20, 2009, with the Japanese Patent Office, the entire contents of which are hereby incorporated by reference.

What is claimed is:

1. A connector apparatus comprising:

first and second connectors that can be engaged with each other;

wherein the first connector includes a pair of first contacts and a first main body that supports the pair of first contacts, the first connector being conductive, the first main body being insulative and having a plurality of outer walls on which, wherein the second connector includes a pair of second contacts and a second main body that supports the pair of second contacts, the pair of second contacts being conductive, the second main body being insulative, wherein each one of the pair of first contacts includes a first connection part that can contact one of the pair of second contacts, wherein each one of the pair of second contacts includes a second connection part that can contact the first connection part at a plurality of portions of the first connection part, wherein the first and second connection parts substantially have the same shape and size, wherein the first and second connection parts are engaged and a first arm part of the first connection part is oriented 180 degrees relative to a second arm part of the second connection part;

wherein each one of the pair of first contacts is provided on each of the outer walls of the first main body facing each other in the Y1-Y2 direction in a state where the first main body is interposed between the pair of first contacts;

wherein the first and second contacts have the same shape and size except for the first arm part and the second arm part that projects outward from each other.

2. The connector apparatus as claimed in claim 1, wherein the first connection part includes a first target support part supported by the first main body and the first arm part that is resiliently bendable where a part of the first target support part contacting the first main body acts as a fulcrum of the resilient bending of the first arm part, wherein the second connection part includes a second target support part supported by the second main body and the second arm part that is resiliently bendable where a part of the second target support part contacting the second main body acts as a fulcrum of the resilient bending of the second target support part, wherein the first arm part resiliently contacts the second target support part by resiliently bending when the first and second connectors engage, wherein the second arm part resiliently contacts the first target support part by resiliently bending when the first and second connectors engage.

3. The connector apparatus as claimed in claim 1, wherein the first and second contacts are configured to transmit signals of positive/negative symmetric waveforms.

* * * * *